US012060095B2

(12) United States Patent
Bramucci et al.

(10) Patent No.: US 12,060,095 B2
(45) **Date of Patent: *Aug. 13, 2024**

(54) ALERTING SYSTEM AND METHOD

(71) Applicant: Westinghouse Air Brake Technologies Corporation, Pittsburgh, PA (US)

(72) Inventors: Joshua M. Bramucci, Elkridge, MD (US); Benjamin Henniges, Mt. Airy, MD (US); Jeffrey D. Kernwein, Cedar Rapids, IA (US); Michael Bratcher, Azle, TX (US); Kristofer M. Ruhland, Cedar Rapids, IA (US); Karen A. Shaw, Cedar Rapids, IA (US); James L. Fenske, Marion, IA (US)

(73) Assignee: Westinghouse Air Brake Technologies Corporation, Pittsburgh, PA (US)

( * ) Notice: Subject to any disclaimer, the term of this patent is extended or adjusted under 35 U.S.C. 154(b) by 409 days.

This patent is subject to a terminal disclaimer.

(21) Appl. No.: 17/474,011

(22) Filed: Sep. 13, 2021

(65) Prior Publication Data

US 2021/0403062 A1 Dec. 30, 2021

Related U.S. Application Data

(63) Continuation-in-part of application No. 16/557,408, filed on Aug. 30, 2019, now Pat. No. 11,148,692, (Continued)

(51) Int. Cl.

| | |
|---|---|
| ***B61L 27/70*** | (2022.01) |
| ***B61L 3/12*** | (2006.01) |
| ***B61L 15/00*** | (2006.01) |
| ***B61L 23/04*** | (2006.01) |
| ***B61L 27/53*** | (2022.01) |

(52) U.S. Cl.

CPC ..... *B61L 27/70* (2022.01); *B61L 3/125* (2013.01); *B61L 15/0062* (2024.01); *B61L 15/0063* (2013.01); *B61L 23/041* (2013.01); *B61L 27/53* (2022.01)

(58) Field of Classification Search

CPC ..... B61L 23/041; B61L 27/70; B61L 27/53; B61L 3/125; B61L 3/008; B61L 15/0063

See application file for complete search history.

(56) References Cited

U.S. PATENT DOCUMENTS 5,805,797 A * 9/1998 Sato ..... G06F 11/165 714/E11.017
7,395,141 B1 * 7/2008 Seck ..... B61C 17/12 701/19

(Continued)

*Primary Examiner* — Peter D Nolan
*Assistant Examiner* — Wae L Louie
(74) *Attorney, Agent, or Firm* — K&L Gates LLP

(57) ABSTRACT

A system is provided that include at least one positioning system that can detect a location or position of a vehicle or a portion of a vehicle group that includes the vehicle, at least one sensor positioned on or associated with the vehicle that can generate sensor data of a determined parameter or condition, and a controller in communication with the sensor and the positioning system. The controller can determine that a hazard event has occurred based at least partially on sensor data, and can communicate a hazard event notification based at least in part on the location data and the sensor data to a remote server.

19 Claims, 3 Drawing Sheets

Related U.S. Application Data which is a continuation-in-part of application No. 16/110,415, filed on Aug. 23, 2018, now Pat. No. 10,919,551, and a continuation-in-part of application No. 15/592,760, filed on May 11, 2017, now abandoned, and a continuation-in-part of application No. 15/062,459, filed on Mar. 7, 2016, now Pat. No. 10,479,380, said application No. 16/110,415 is a continuation of application No. 14/032,710, filed on Sep. 20, 2013, now Pat. No. 10,081,378.

(60) Provisional application No. 61/703,531, filed on Sep. 20, 2012.

(56) References Cited

U.S. PATENT DOCUMENTS 8,714,494 B2 * 5/2014 Weber ..... B61L 15/0027 701/19
10,946,878 B1 3/2021 Beard et al.
10,977,943 B1 4/2021 Hayward
2004/0019696 A1 * 1/2004 Scott ..... H04L 67/02 709/242
2004/0093196 A1 * 5/2004 Hawthorne ..... B61L 27/60 703/8
2004/0230982 A1 * 11/2004 Wookey ..... G06Q 10/00 709/201
2005/0205718 A1 * 9/2005 Tsai ..... B61L 23/041 246/1 R
2006/0022063 A1 * 2/2006 Tsai ..... E01B 26/00 238/8
2011/0075641 A1 * 3/2011 Siriwongpairat ..... H04W 4/12 370/337
2011/0276285 A1 * 11/2011 Alexander ..... B61L 1/20 702/58
2012/0123617 A1 * 5/2012 Noffsinger ..... B61L 15/0081 701/19
2014/0014784 A1 * 1/2014 Brown ..... B61L 15/0027 246/167 D
2014/0107875 A1 * 4/2014 Beyer ..... B61L 15/0036 701/19
2014/0131524 A1 * 5/2014 Grimm ..... B61L 27/00 246/3
2014/0172205 A1 * 6/2014 Ruhland ..... B61L 15/0063 701/19
2015/0239481 A1 * 8/2015 Dymek ..... B61L 27/20 701/19
2015/0338848 A1 * 11/2015 Kumar ..... G07C 5/0816 701/29.2
2016/0001801 A1 * 1/2016 Ruhland ..... B61L 15/0018 701/19
2016/0082988 A1 * 3/2016 Kurz ..... B61L 15/0027 701/19
2016/0272228 A1 * 9/2016 LeFebvre ..... H04L 67/12
2018/0222505 A1 * 8/2018 Chung ..... B61L 27/14
2019/0263432 A1 * 8/2019 Carlson ..... H04W 4/40

* cited by examiner

ALERTING SYSTEM AND METHOD

CROSS-REFERENCE TO RELATED APPLICATIONS

This application is a continuation-in-part of U.S. patent application Ser. No. 16/557,408 (filed 30 Aug. 2019), which is a continuation-in-part of U.S. patent application Ser. No. 15/062,459 (filed 7 Mar. 2016, now U.S. Pat. No. 10,479,380); is a continuation-in-part of U.S. patent application Ser. No. 15/592,760, filed 11 May 2017; and is a continuation-in-part of U.S. patent application Ser. No. 16/110,415 (filed 23 Aug. 2018, now U.S. Pat. No. 10,919,551). U.S. patent application Ser. No. 16/110,415 is a continuation of U.S. patent application Ser. No. 14/032,710 (now U.S. Pat. No. 10,081,378), filed 20 Sep. 2013, which claims priority to U.S. Provisional Application No. 61/703,531, filed 20 Sep. 2012. The entire disclosures of these foregoing patent applications are incorporated herein by reference.

BACKGROUND

Technical Field

Embodiments of the subject matter disclosed herein relate to a monitoring system and method for use with a vehicle.

Discussion of Art

Some first responders to hazard events may be unaware of what types of hazardous materials may be carried on a transport vehicle. An operator of the transport vehicle may be obliged to follow an emergency response plan, but may be incapacitated. Depending on the cause of the hazard event, the vehicle may be unable to send notifications that the hazard event has occurred. It may be desirable to have a system and method that differs from those currently available.

BRIEF DESCRIPTION

In one embodiment, a system is provided that includes at least one positioning system that can detect a location or position of a vehicle or a portion of a vehicle group that includes the vehicle, at least one sensor positioned on or associated with the vehicle that can generate sensor data of a determined parameter or condition, and a controller in communication with the sensor and the positioning system. The controller can determine that a hazard event has occurred based at least partially on sensor data, and can communicate a hazard event notification based at least in part on the location data and the sensor data to a remote server.

In one embodiment, a method includes detecting at least one parameter or condition associated with a hazard event; detecting a position or location of a vehicle at a time of occurrence of the hazard event; and transmitting selectively to a remote server a hazard event notification that is based at least partially on a detected parameter or condition and the position or location of the vehicle.

BRIEF DESCRIPTION OF THE DRAWINGS

The subject matter described herein includes descriptions of non-limiting embodiments, with reference to the attached drawings, wherein below.

DETAILED DESCRIPTION

Embodiments of the subject matter disclosed herein relate to a system that includes at least one positioning system that can detect a location or position of a vehicle or a portion of a vehicle group that includes the vehicle, at least one sensor positioned on or associated with the vehicle that can generate sensor data of a determined parameter or condition, and a controller in communication with the sensor and the positioning system. The controller can determine that a hazard event has occurred at least partially based on sensor data, and can communicate a hazard event notification based at least in part on the location data and the sensor data to a remote server.

In one embodiment, a method includes detecting at least one parameter or condition associated with a hazard event, detecting a position or location of a vehicle at a time of occurrence of the hazard event, and selectively transmitting a hazard event notification to a remote server. This notification is based at least partially on a detected parameter or condition and the position or location of the vehicle.

Figure 1:
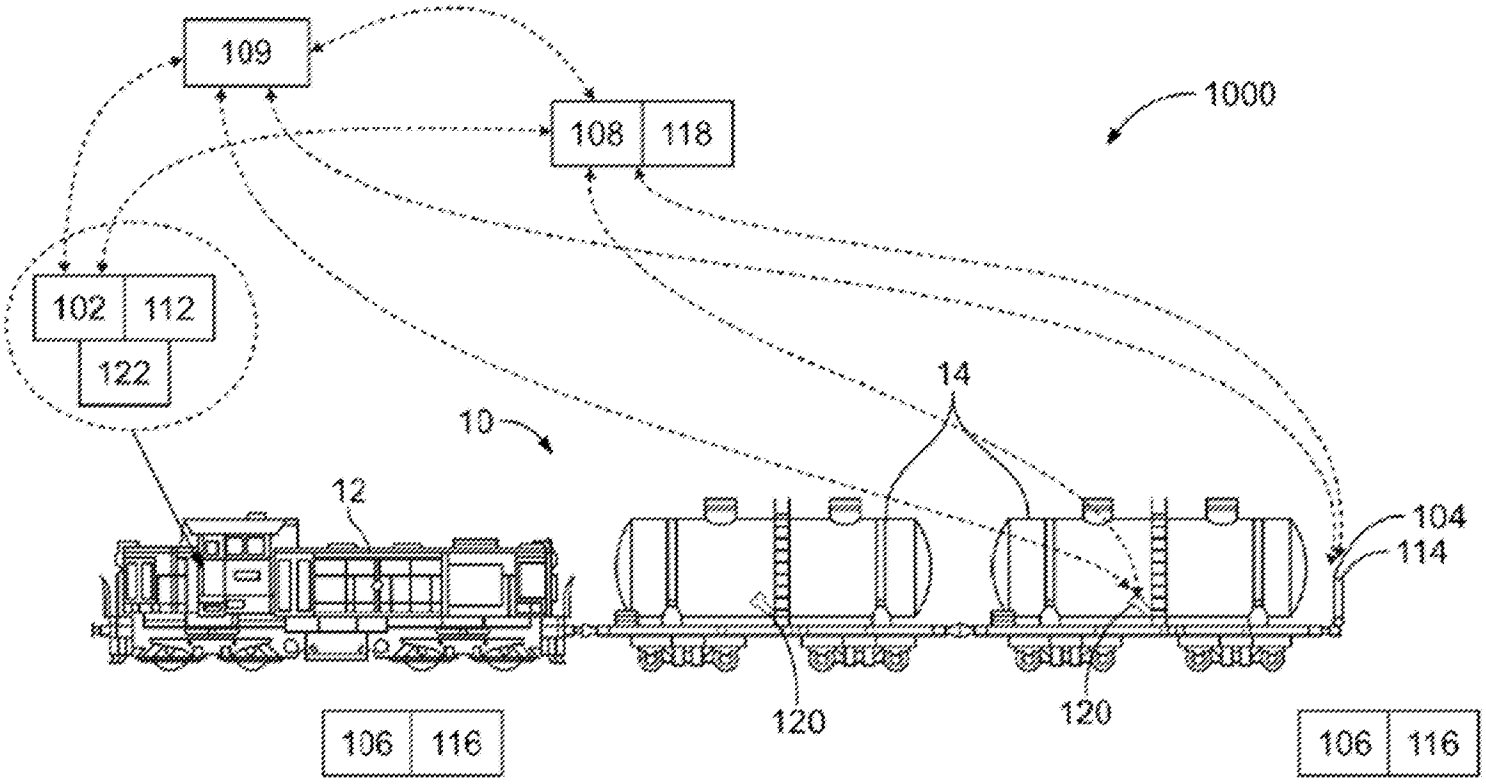
FIG. 1 illustrates a hazard event alert system.

With reference to FIG. 1, a hazard event alert system 1000 for a vehicle group may include a sensor 120, one or more communication devices 112, 116, 118, a positioning system 122, and a controller 102. The controller may represent an end-of-train (EOT) and/or head-of-train (HOT) computer 104 and/or a vehicle group controller 106. The computer and/or controllers can each or collectively represent hardware circuitry that includes and/or is connected with one or more processors (e.g., one or more microprocessors, one or more field programmable gate arrays, one or more integrated circuits, etc.). The communication devices may communicate with the sensor, the positioning system, the controller, and one or more remote servers 108. Alternatively, the controller can represent other hardware circuitry that includes and/or is connected with one or more processors, but is not included in or does not represent an EOT or HOT computer.

As used herein, the terms "communication", "communicate" and "communicatively coupled" refer to the receipt, transmission, or transfer of one or more signals, messages, commands, or other type of data. For one unit or device to be in communication with another unit or device can include the one unit or device being able to receive data from and/or send data to the other unit or device. A communication may use a direct or indirect connection and may be wired and/or wireless in nature. Additionally, multiple units or devices may communicate with each other even though the data transmitted may be modified, processed, routed, etc., between the units or devices. For example, a first unit may communicate with a second unit even though the first unit passively receives data and does not actively transmit data to the second unit. As another example, a first unit may communicate with a second unit if an intermediary unit processes data from one unit and transmits processed data to the second unit. Other arrangements are possible and depend on application specific circumstances. Suitable electronic communication protocols and/or algorithms may include TCP/IP (including HTTP and other protocols), WLAN (including 802.11 and other radio frequency-based protocols and methods), analog transmissions, and cellular networks. Suitable cellular networks may include Global System for Mobile Communications (GSM), Code Division Multiple Access (CDMA), Long-Term Evolution (LTE), Worldwide Interoperability for Microwave Access (WiMAX)), and/or the like. Other suitable communication modes may include low Earth orbit (LEO) satellite communications, as well as optical data transmission systems.

As used herein, a hazard event is an occurrence of which a notification should be made so as to address the aftermath or impact of the hazard event. Examples of hazard events may include a derailment of a locomotive or rail car, a crash of a car or truck, a ship that has run aground, spilling of cargo carried by a vehicle, an incapacitated operator (on-board or off-board) of a vehicle, a fire onboard a vehicle, a rockslide, a landslide, a flood, tornado, hurricane, other weather conditions, etc. Other examples may include damage to a route over which a vehicle may travel (regardless of whether the vehicle is damaged or involved in the event). A bridge being washed out and a stalled vehicle blocking the bridge are both obstacles, but the corrective action for each condition differs. Further, the hazard event may be an increased likelihood of blockage based on location predictions and risk tolerance. For example, if a vehicle is to travel on route segment of a road that runs through a forest that is partially on fire, the vehicle and the road may be unblocked, but the segment of the road that travels through the forest may, under certain conditions, be classified as a hazard event based on the risk level set by the roadway or railroad; the location, direction and speed of the fire near the route segment of road; and the location, direction and speed of the vehicle relative to the route segment of the road.

The sensor may be positioned on or associated with at least one vehicle in a group of vehicles. One example of a group of vehicles that may be coupled together is a train that includes one or more locomotives and railcars, and in which the vehicles are both mechanically and communicatively coupled. Another example is a platoon of on-road vehicles or aerial drones that may only be communicatively coupled. For example, communicatively coupled vehicles includes vehicles that are not mechanically coupled but that communicate with each other during movements of the vehicles so that the vehicles can coordinate their movements with each and move along one or more routes as a group of vehicles. A vehicle group of a single vehicle is referred to herein simply as a vehicle, and the vehicle group may include one or more vehicles that are at least communicatively coupled such that movement of the group of vehicles is coordinated via the communicative coupling. Alternatively, the sensor may be off-board vehicles. For example, the sensor may be included in or part of a wayside device that is fixed to the ground or otherwise stationary.

Examples of sensors include an accelerometer, a pressure sensor, a thermocouple, a microphone, a camera, and a rotational sensor. A sensor system may include a housing and a wireless communicator. The sensor system may include a power source, such as a battery, a solar cell, a piezoelectric shaker, and the like. In one embodiment, the sensor may communicate with another sensor to pass messages along to a controller, an EOT, a wayside device, and/or a remote server. The sensor may report that at least one parameter or condition associated with a hazard event has been sensed or determined.

A sensor may sense, measure or determine a parameter or condition associated with a hazard event. The parameter or condition may be associated with one or more vehicles in the vehicle group, or the route, or wayside equipment that is proximate to the route, or an inspection unit that is inspecting a portion of the route or the vehicle, or area or environmental information systems (such as weather alerts or emergency broadcasts). When referring to the route, adjacent and proximate route considerations are included. Examples of vehicle related parameters or conditions associated with a hazard event include an acceleration event, a deceleration event, a brake pipe pressure, a vibration, a tilt of a vehicle, a vehicle speed, a vehicle component temperature, and/or other like conditions or parameters. Other suitable conditions or parameters may include the deployment of an airbag, an optical signal, a lidar or radar signal, an acoustic event, deployment of brakes, a waveform signal generated by a traction motor (or the loss thereof), a battery charge level, a battery temperature level, smoke detection, gas leak detection, fuel leak detection, and lubricant leak detection. Acoustic events may include a determined sound profile configurable from a gunshot, the sound of breaking glass, a human voice, sirens, and the like.

The sensors located at or associated with a vehicle may form part of, may include, or may be connected to a controller, an EOT, a wayside device, a remote server, and/or a positioning device. A sensor may be attached or installed on a vehicle or vehicle accessory, such as a semi-truck, trailer, automobile, marine vessel, locomotive, a railcar, EOT, mining equipment, aircraft, or other vehicle of the vehicle group.

A suitable sensor system may have a fastener. Suitable fasteners may include a magnetic or adhesive pad on its housing or a mechanical clamp. In one embodiment, the sensor may include a mobile or stationary device that has capabilities for sensing or determining a vertical and/or lateral acceleration and/or other movement of the vehicle.

The communication device may be onboard a vehicle in the vehicle group. The communication device may receive, process, and/or transmit data. The positioning system may sense or determine a location or position of a vehicle in the vehicle group, and by extension, the vehicle group itself. The controller may be positioned in or associated with a vehicle in the vehicle group. The controller may communicate with the sensor, the communication device, and the positioning system. The controller may generate or receive a notification based at least partially on the parameter or condition sensed or determined by the sensor. The controller may determine or receive a location or position of at least a portion of the vehicle group based at least partially on the location or position sensed or determined by the at least one positioning system. The controller may communicate a notification of a hazard event between the computers, to a remote server associated with a specified entity, to a back-office system (BOS), an emergency management service, or a combination of two or more thereof. In one embodiment, the controller may be an on-board computer. Suitable on-board computers may include a vehicle controller, an end-of-train (EOT) device, an Edge device (such as EdgeLINC™ from Wabtec Corporation) and the like.

FIG. 1 shows the hazard event alert system 1000. The system is an example for a railroad scenario and includes a vehicle group 10 that is a train. The train includes a first vehicle 12 that is a locomotive and one or more additional vehicles 14 that are railcars. A controller may be located in or associated with the locomotive. The first vehicle can be referred to as a propulsion-generating vehicle (e.g., automobile, locomotive, truck, agricultural vehicle, mining vehicle, marine vessel, etc.) while the additional vehicles can be referred to as non-propulsion-generating vehicles (e.g., railcars, trailers, barges, etc.). While a rail vehicle system is shown in FIG. 1, the system 1000 may be used in connection with other types of vehicles.

The controller may form part of, may include, or may be connected to another device and/or system with a separate function in the propulsion-generating vehicle. The other functional device may be, for example, an Energy Management System (EMS), a network management system, a Positive Train Control (PTC) system, a head-end-unit (HEU) system, a Head-of-Train device (HOT), a vehicle group (e.g., consist) management computer, a distributed power system (such as LocoTROL™ from Wabtec Corporation), a route manager and vehicle dispatch system, and/or a locomotive cab unit system. In one embodiment, the controller is a separate device or system relative to the vehicle on which it is disposed rather than integrated with a system that is dedicated to another function.

Suitable controllers may be a stationary device or a mobile device, such as an application-specific integrated device or a mobile device. Suitable mobile devices may include wearable electronics, a smartphone, laptop, or tablet computer. In one embodiment, the processing and control device is an edge-based computing device. The controller may communicate with one or more EOT devices, one or more wayside devices, one or more remote servers, one or more sensors, and/or one or more positioning devices. In one embodiment, the controller is part of the EOT.

Suitable remote servers may include a cloud-based computing platform. Depending on the application, wired and wireless communication may be used and the various devices, including the controller, may communicate via one or more communication devices. As an example of wired communication, communication may be performed using a vehicle power line running from the lead to the rear of a group of mechanically coupled vehicles. In one embodiment, the sensors may communicate with the EOT, controller, and/or remote servers.

The controller may receive a notification (e.g., an alert or other message) concerning the occurrence of one or more parameters or conditions sensed or determined from a sensor. In various embodiments, the notification may come from an onboard device (e.g., the EOT device) and/or an off-board device (e.g., a wayside device). The controller may confirm receipt of a notification received from the EOT and/or the off-board or wayside device. In one embodiment, the wayside device is a portable, person-carried device. In another embodiment, the wayside device is a permanently or semi-permanently installed device proximate to the route or a feature on the route (such as an intersection, bridge, switch, and the like).

A wayside device may include one or more transponders, transceivers, or other information transmitter. The transponder may be powered or may be passive depending on the application specific parameters. In one embodiment, there may be a plurality of passive transponders located throughout a vehicle route network, where each includes transponder data uniquely identifying a route segment or location where the transponder is positioned. The positioning may be strategic, such as proximate to a determined portion of a track, a switch, a region's boundary, determined coordinates, and/or the like. The transponder data may include an identifier that is correlated with a location stored in a route database or a map. Moreover, the transponders may be located throughout the route network, including adjacent to an intersection or a clearance point of a switch, or adjacent a route segment approaching a clearance point of a switch or intersection. The system may be used or coordinated with the control and movement of a vehicle, or a group of vehicles, by establishing boundaries or geofences that may be used for traffic control or the like.

A suitable transponder may be a passive radio frequency identification (RFID) transponder (e.g., tag) and signal receiving device may be an RFID reader that energizes the transponder to retrieve data stored thereon. Other suitable transponders may include a near field communication (NFC) tags, low-power Bluetooth® devices, and/or the like. In one embodiment, the sensor is an optical sensor that can interact with, for example, one or more printed data sources (e.g., a two- or three-dimensional barcode, a visual code, printed text, etc.). In such examples, the sensor (or a complimentary device) may illuminate the printed data source (e.g., with an infrared light or another light source) and capture the data printed thereon as an image capture device. The controller may then decode and/or process the captured image to obtain the data encoded or printed thereon.

During operation, a notification concerning an occurrence of a parameter or condition sensed or determined by the sensor may be received by the controller. The controller may communicate a hazard event notification to a remote server associated with a specified entity associated with a governmental agency, regulatory agency, or some other authority or entity, and/or a remote server of a back-office system (BOS) (e.g., a central office associated with the vehicle group and/or responsible for a route network). In one embodiment, the controller may directly communicate a hazard event notification to the remote server.

The controller may communicate a hazard event notification to a remote server associated with a specified entity other than the BOS associated with the vehicle group, and the controller may communicate to such specified entity by other methods. Other suitable methods may include one or more of phone calls, text messages, push notifications, and/or the like. The controller may communicate with the remote server and/or back-office system instead of or in addition to the controller, or when the controller is out of communication with the controller.

The controller may communicate the notification of the hazard event to the remote server of the BOS associated with the vehicle group or the route network (or both), and the remote server may communicate the notification of the hazard event to one or more other remote servers associated with one or more specified entities. The remote server may communicate the notification to other vehicles or vehicle groups that are proximate to the location or position of the hazard event. The remote server may communicate the notification to other vehicles or vehicle groups that are distant from the location or position of the hazard event, but are traveling toward or scheduled to travel toward the location or position of the hazard event. Optionally, the sensor may be part of the wayside device and communicate the notification (or warning) of the hazard to the vehicle(s). In another example, the sensor may be onboard a vehicle and the notification or warning of the hazard can be communicated to other vehicles and/or wayside device(s). The remote server, vehicle, or wayside device may selectively notify other vehicles based on determined factors. Suitable factors may include the amount of elapsed time between the occurrence of the hazard event and the approach of the other vehicles, whether the other vehicles are traveling on the same route as the hazard event (same tracks or same lane of a road) or merely proximate to (a nearby set of tracks, or the other side of a multi-lane road), the type of hazard event, the nature of any cargo spilled, the types of vehicles involved, the time of day or time of year, weather and environmental conditions, and whether a response team has arrived at the location or position of the hazard event.

The remote server of the specified entity may be selectively determined based on the circumstances of the hazard event. The controller and/or EOT may communicate a notification of the hazard event to a remote server associated with a specified entity other than the central office associated with the vehicle group in addition to or instead of communicating a notification of the hazard event to a remote server of the BOS associated with the vehicle group.

A notification of a hazard event communicated by the controller may push an alert to users and first responders who have a software application installed on a mobile device. The alert may contain a location of the event, a material transported by the vehicle (e.g., as may be determined based on operator input to the controller, from a manifest provided to the controller, from an optical scan of indicia associated with the material container, etc.), an amount of material, media (e.g., photographs, images, and/or video), and/or recommended actions to take in response to the hazard event. A notification of the hazard event communicated by the controller and/or EOT may include audio, graphic and/or video information. Audio and/or video information may be received via an input device associated with the controller, EOT, or a mobile device and displayed thereon. As an example, the audio and/or video information may be captured by a camera and/or microphone in communication with the controller and/or EOT. It may be captured by an operator of the vehicle or crewmember with a mobile device having a camera and/or microphone.

A notification of the hazard event communicated by the controller may result in a route designation that a hazard event may exist, or will exist (e.g., the vehicle is headed toward a fire, collision, obstacle, etc.), in a determined location. Hazard event information may then be disseminated to other vehicles and vehicle groups and/or operators of such vehicle groups who can then adjust and respond accordingly.

In one embodiment, the hazard event may be a predicted event. The hazard may not have occurred yet, but the sensed conditions and/or locations may indicate that the hazard event is likely to occur. For example, the controller can examine the locations of vehicle groups and the sensed conditions to determine that the vehicle groups are headed toward each other, are headed toward an obstacle, are headed toward another impassable situation (e.g., a washed out bridge), etc. Even though the hazard involving the vehicle group(s) has not yet occurred, the sensed conditions and locations indicate that the hazard event is more likely than not to occur. The controller can then communicate the notification to warn those vehicle group(s), other vehicle groups, the dispatcher, wayside devices, etc., of the predicted impending hazard event.

As another example, the controller can receive (e.g., from the operator, from an off-board system or source, such as a weather reporting system) weather conditions that may indicate that the hazard is more likely to occur (e.g., relative to other weather conditions). For example, if there has been significant rainfall (e.g., more than a threshold amount, such as more than two centimeters of precipitation within twenty-four hours), earthquakes, temperature variations, or the like, the controller may determine that a landslide or rockslide is likely to happen (or more likely to happen). Even though the landslide or rockslide has not occurred, the controller can send a signal to another vehicle, a wayside device, the BOS, or the like, to warn of the potential hazard. This can help other vehicles from colliding with or otherwise traveling into the hazard.

The controller may communicate the notification of the hazard event before or after validation or invalidation, or may communicate the notification without validation or invalidation. For example, in response to detecting a parameter or condition, an operator of the vehicle group may be presented with an indication of the alert with options to validate (e.g., confirm) or invalidate (e.g., cancel) the alert. The controller may communicate the notification of the hazard event to a remote server associated with the back-office system, to another vehicle, or to a wayside device before validation or invalidation. The controller may communicate the notification to the remote server associated with a specified entity, the other vehicle(s), and/or the wayside device after the alert is verified or after a determined time period elapses without any input being received from the operator of the vehicle group. The notification may be communicated to the remote server associated with the back-office system after validation or the expiration of the determined time period.

The controller may communicate the notification of the hazard event to a remote server of the BOS associated with the vehicle group, another vehicle, and/or the wayside device before validation or invalidation, and may again communicate the notification of the validated hazard event to the remote server of the BOS, to another remote server associated with a specified entity other than the central office associated with the vehicle group, to another vehicle, and/or to the wayside device. By way of another non-limiting example, the controller may wait for validation or invalidation before communicating the notification of the hazard event to a remote server associated with a specified entity and the remote server of the back-office system associated with the vehicle group and/or to another remote server associated with another specified entity.

After invalidation of the occurrence of the hazard event, the controller may still communicate the notification of the invalidated hazard event to the remote server of the back-office system associated with the vehicle group for recordation or other purposes.

In the case that the occurrence of a hazard event is neither validated nor invalidated within a determined time period, the controller may communicate the notification of the hazard event to a remote server of the back-office system associated with the vehicle group and the remote server associated with a specified entity other than the back-office system associated with the vehicle group.

The controller may communicate the notification of the hazard event to a remote server of a back-office system associated with the vehicle group before validation or invalidation, and after the hazard event is neither validated nor invalidated within a determined time period, the controller may communicate the notification of the unconfirmed hazard event to the remote server of the back-office system associated with the vehicle group and/or to another remote server associated with another specified entity.

The identity of the hazard event may be sent to the remote server with the notification of the hazard event, or the identity of the hazard event may be sent separately. In one embodiment, the remote server may obtain information from social media sources that relate to the hazard event. For example, text, pictures, or video of a hazard event may be posted on publicly available websites or mobile device applications, private websites or mobile device applications, or the like, where people can share the text, pictures, and/or video. If this posted information is stamped with the proper time and location to correspond with the occurrence of the hazard event the contents may be used to validate the occurrence, then the controller and/or BOS can download the text, pictures, and/or video. Further, pictures may be used to help determine the scope or size of the hazard event. The number of related social media posts may be used to help determine an affected population size and/or scope of the area affected by the hazard event.

For validation, the controller may validate or invalidate the occurrence of a hazard event communicating with an operator of the vehicle group and/or by relying on other information. By way of example, a notification of at least one parameter or condition sensed or determined by a second sensor may be used to validate the at least one parameter or condition sensed or determined by a first sensor.

In the case of validating or invalidating the occurrence of the hazard event based on communications with an operator of the vehicle group, the controller may include and/or be in communication with one or more input devices and/or one or more output devices. An input device may include but is not limited to a keyboard, mouse, joystick, audio input, and/or video input. An input device may include a stationary input device and/or a mobile input device. By way of another non-limiting example, the stationary input device may include a mounted microphone and/or mounted camera. The mobile input device may include a handheld phone and/or handheld camera. The input device may include a stationary input device and/or a mobile input device. The static and/or mobile output device may include an audio output device, such as a speaker and/or a display, and/or a video output device, such as a handheld phone or a handheld display. The input device and the output device may be the same or separate devices and/or systems.

The controller may validate or invalidate the occurrence of the hazard event based on communications with an operator of the vehicle group. The controller may validate or invalidate the occurrence of the hazard event by generating a prompt to an operator of the vehicle group via the output device. The controller may further request validation or invalidation from the operator of the occurrence of a hazard event via the input device. If validation of the occurrence of the hazard event is received via the input device, then the controller may communicate a notification of a hazard event to one or more remote servers as described above. If the occurrence of the hazard event is invalidated, then the controller may or may not communicate a notification of an invalidated hazard event to the remote servers and may, in some examples, communicate the notification only to the remote server of the back-office system.

If no validation or invalidation of the occurrence of the hazard event is received via the input device within a determined time period, which may indicate the unavailability of the operator, then the controller may communicate a notification of a hazard event to the remote servers after determined conditions are met, such as a determined amount of time for the operator to validate or invalidate the occurrence of the hazard event. The controller may determine the specified entity to be contacted based on whether the occurrence of the hazard is validated, invalidated, or unconfirmed.

The controller may receive a notification of an occurrence of a hazard event from an operator of the vehicle group via an input device with or without a parameter or condition being previously sensed or determined by a sensor. In this case, the controller may communicate the notification of the hazard event to a remote server of the back-office system associated with the vehicle group and/or may communicate the notification of the hazard event to a remote server of another specified entity.

The controller may include a database of hazard event categories. The hazard event categories may include any hazard event category that is required, encouraged, and/or accepted by a specified entity, such as a federal government authority, a state government authority, a local government authority, a central office associated with the vehicle group, another vehicle group, a central office associated with another vehicle group, a maintenance entity, a medical entity, a search and rescue entity, a state police, a local police, an agency related to homeland security, or any combination thereof. The hazard event categories may include a category for a vehicle collision event, for a vehicle derailment event, for vehicle failure, for route damage, for route congestion, for route blocking, and for predictive (rather than actual) instances of the foregoing. The controller may determine the specified entity to be contacted based on the identity of the hazard event.

The controller may include a database of determined hazard event severity categories. The severity categories may include any severity category that is required, encouraged, and/or accepted by a specified entity, such as a federal government authority, a state government authority, a local government authority, a central office associated with the vehicle group, another vehicle group, a central office associated with another vehicle group, a maintenance entity, a medical entity, a search and rescue entity, a state police, a local police, an agency related to homeland security, or any combination thereof. For example, a severity category may be based on a number of railcars affected by the hazard event, a location of the hazard event, a type of track at the location of the hazard event, a grade of the land at the location of the hazard event, and/or a proximity to persons and/or structures potentially affected at the location of the hazard event. For example, severity categories may be based in part on a number of vehicles affected by the hazard event, which may be determined by a number of sensors sensing or determining an at least one parameter or condition associated with a hazard event. In one embodiment, the severity categories may be based in part on whether a vehicle remains upright (determined from an at least one parameter or condition sensed by a sensor). The controller may determine a specified entity to be contacted based on the severity of the hazard event. The severity of the hazard event may be sent to the remote server with the notification of the hazard event, or the severity of the hazard event may be sent separately.

The controller may receive location data from a positioning device. The positioning device may be located at or associated with a single vehicle of the vehicle group, one or more vehicles of the vehicle group, or a portion of the track. The positioning device may form part of, may include, or may be connected directly to a controller, or to an EOT, a wayside device, a remote server, and/or a sensor. The positioning device may be located in or on one or more vehicles in the vehicle group. Optionally, the positioning device may be off-board the vehicle group (e.g., a stationary sensor that detects presence or passage of the vehicle group by the positioning device (e.g., a camera, infrared sensor, etc.). The controller may determine the entity to be contacted based on the location of the occurrence of the hazard event. The controller may communicate the location of the vehicle group and/or the occurrence of the hazard event to the remote servers. The location data may be sent to the remote servers with the notification of the hazard event, or the location data may be sent separately.

Suitable positioning devices may include one or more of global positioning systems (GPS), axle counters, signal triangulation, wheel tachometers, or other devices that generate output that can be used by the controller to determine or estimate the location of a vehicle or vehicle group. For example, the axle counters may be fixed to a route and count the number of axles passing by the axle counters. An axle counter can be associated with a known location. Responsive to detecting passage of a number of axles associated with a vehicle group, the axle counter can output a data signal that indicates that the vehicle group passed the location of the axle counter. As another example, the wheel tachometers may output signals indicative of how often the wheels or axles are rotating. The controller may be provided with sizes of the wheels and at least one known location of the vehicle or vehicle group. The controller can then calculate a location of the vehicle or vehicle group based on the known location, how many wheel revolutions have occurred based on the wheel tachometer output, and the sizes of the wheels. The positioning device may form part of, may include, or may be connected to a Global Positioning System (GPS) for sensing or determining a location or position of at least a portion of the vehicle group. The positioning device may determine location based on a stationary marker, such as a milepost marker, based on velocity data, and/or based on information received from a wayside device. The positioning devices may communicate with one or more controllers, one or more end-of vehicle group computers, one or more wayside computers, one or more remote servers, one or more sensors, and/or one or more additional positioning devices.

Optionally, the controller can determine the location of the vehicle or vehicle group by communicating with a vehicle location server that is located off-board the vehicle group. The vehicle location server tracks and updates the location of one or more vehicles in a determined area in real-time or near-real-time, although lag may occur in the update process and/or vehicle may lose communication as to prevent updating from time to time. One example of a rail vehicle location server for a rail-based implementation may include a train location server optionally coupled with a positive train control (PTC) system. The train location server may record a latest or current locomotive position of a locomotive equipped with a PTC On-Board System. The update may include information about the track network and locations at which trains in the track network have requested polling. The polling and/or the update may be based on the messages forwarded by a PTC message router. The vehicle location server may forward the train location information including the current locomotive positions and the polling positions of each of the trains (TR) in the track network to each other train (TR) in the track network. The vehicle location server may selectively forward to propulsion-generating vehicles that report operating at restricted speed. For example, the train location information can include the location or position of the train (TR) in the track network, the location or position of at least one locomotive or control car (L) in the track network, the location or position of the at least one railroad car (RC) in the track network, the location or position of a target location, and the location or position of the target with respect to the location or position of the train (TR) in the track network or the location or position of the at least one locomotive or control car (L) in the track network. The target may be a switch location or a track heading change, such as a curve or a hill, or another aspect associated with the track network. Suitable train location information can include current speeds of the trains (TR), current accelerations of the trains (TR), a number of locomotives (L) in the trains (TR), a number of railroad cars (RC) in the trains (TR), a total length of each of the trains (TR), or a combination of two or more thereof, the type of locomotive, the type of railcar, the type of the target, the location of the target, operating parameters of the locomotive(s), environmental conditions at the location, and the presence or absence of a hazard event. The vehicle location server can be queried for, among other things, the location of a vehicle or group of vehicles, and the freshness of the location information—a "last known address" and how long ago the vehicle was known to be at the location.

The controller may access a database of determined communications to be made in the event of a hazard event. The database of determined communications to be made may include any communication that is required, encouraged, and/or accepted by a specified entity, such as a federal government authority, a state government authority, a local government authority, a central office associated with the vehicle group, another vehicle group, a central office associated with another vehicle group, a maintenance entity, a medical entity, a search and rescue entity, a state police, a local police, an agency related to homeland security, or any combination thereof. The database of determined communications may include contact information for railroads and/or first responders.

The database of determined communications may select which of the specific entities to be contacted based on one or more circumstances related to the hazard event. The one or more circumstances may include the category of the hazard event, the severity of the hazard event, and/or the location of the hazard event.

The controller may include an event log in the form of a data storage device and/or system. The event log may record the occurrence of one or more parameters or conditions sensed or determined by a sensor, one or more notifications based on one or more parameters or conditions sensed or determined by the sensor, one or more validated hazard events, one or more invalidated hazard events, and/or one or more notifications of hazard events received from an operator of the vehicle group via an input device, but the event log is not limited thereto.

The controller may include a materials storage log in the form of a data storage device and/or system. The materials storage log may record the type of hazard materials being transported, how much material is being transported, and/or how to properly respond to the hazard event for the given hazard material, but at least a part of the materials storage log is not limited thereto. The materials storage data may be sent to the remote server with the notification of the hazard event or a portion of the materials storage data may be sent separately.

The EOT may form part of, may include, or may be connected to another device and/or system located in or associated with the vehicle. By way of a non-limiting example, another device and/or system may include a smart end-of-vehicle group device that includes a flashing rear-end device, a device and/or system that monitors brake line pressure, a device and/or system that monitors for accidental separation of the vehicle group, and/or a device and/or system that transmits data to the locomotive. The EOT may be a separate device and/or system.

The EOT may include, or communicate with one or more controllers, one or more wayside computers, one or more remote servers, one or more positioning devices, and/or one or more sensors. The EOT may communicate via one or more communication devices 114. The EOT may directly and/or indirectly receive a notification concerning the occurrence of a parameter or condition sensed or determined from a sensor. In the case that a notification concerning an occurrence of a parameter or condition sensed or determined by the sensor may be received by the EOT, the EOT may communicate a hazard event notification to a controller, to a wayside device, and/or to a remote server associated with a specified entity.

In the case that the EOT communicates the notification of the hazard event to the controller, the EOT may receive confirmation of receipt of the notification communicated from the EOT to the controller. The EOT may receive the confirmation of receipt after communicating a request for a confirmation of receipt of the notification to the controller. By way of another non-limiting example, the EOT may receive the confirmation of receipt without or before communicating a request for a confirmation of receipt of the notification to the controller.

If the EOT does not receive confirmation of receipt of the notification of the hazard event communicated from the EOT to the controller, which may result due to the unavailability of the operator, the EOT may communicate a hazard event notification to a remote server associated with a specified entity after determined conditions are met, such as a determined amount of time for the controller to confirm receipt of the notification of the hazard event.

The EOT may communicate a hazard event notification to a remote server associated with a specified entity before or without waiting to receive confirmation of receipt of the notification of the hazard event communicated from the EOT to the controller. A notification of a hazard event communicated by the EOT may push an alert to users and first responders who have an alert application installed on their mobile device. The alert may contain a location of the event, a material transported, an amount of material, and/or recommended actions to take in response to the hazard event.

The EOT may receive location data from the positioning device, which may be located in or associated with a vehicle positioned at the rear of the vehicle group relative to a direction of travel. The same for the HOT, except that the vehicle may be located in the front of the vehicle group. As the vehicle group may switch directions, and the vehicles within the group may be changed out for other vehicles or just removed or reordered, the EOT and HOT are discussed in relative terms. The EOT may communicate the location of the vehicle, and thereby the vehicle group, and/or the occurrence of the hazard event to the controller, to a wayside device, and/or to a remote server. The location data may be sent to the controller, the wayside device, and/or the remote server with the notification of the hazard event. The location data may be sent to the controller, the wayside device, and/or the remote server(s) separate from the notification of the hazard event.

The EOT/HOT and sensor system may be one or more of crash-hardened, fire proof, water proof, electrical proofed, EMP resistant, impact resistant, corrosion resistant, and the like. With the selection of features based at least in part on the application specific parameters, the device may continue to function in case of a hazard event to provide redundancy in the ability to communicate a notification of a hazard event, such as in the event of loss of a controller in the vehicle.

The hazard event alert system may include a wayside device located alongside or associated with a portion of a route. The wayside device may form part of, may include, or may be connected to another device and/or system located in or associated with the portion of the route. The wayside device may form part of, may include, or may be connected to a wayside data communications device and/or system and/or an automatic vehicle operation device and/or system. The wayside device may communicate with one or more controllers, one or more EOT/HOT, one or more remote servers, one or more sensors, and/or one or more positioning devices. The wayside device may communicate via one or more communication device.

The wayside device may receive a notification concerning the occurrence of a parameter or condition sensed or determined from a sensor. In case that a notification concerning the occurrence of a parameter or condition sensed or determined by the sensor is received by the wayside device, the wayside device may communicate a hazard event notification to a controller, to an EOT, to a remote server associated with a specified entity, and/or to other vehicles.

In the case that the wayside device communicates the notification of the hazard event to the controller, the wayside device may receive confirmation of receipt of the notification communicated from the wayside device to the controller. The wayside device may receive the confirmation of receipt after communicating a request for a confirmation of receipt of the notification to the controller. The wayside device may receive the confirmation of receipt without or before communicating a request for a confirmation of receipt of the notification to the controller.

If the wayside device does not receive confirmation of receipt of the notification of the hazard event communicated from the wayside device to the controller, which may result due to the unavailability of the operator, the wayside device may communicate a hazard event notification to one or more remote servers.

A notification of a hazard event communicated by the wayside device may push an alert to users and first responders who have an alert application installed on their mobile device. The alert may contain a location of the event, a material transported, an amount of material, and/or recommended actions to take in response to the hazard event. A notification of a hazard event communicated by the wayside device may result in a track restriction so that other vehicle groups would be aware of the incident and take appropriate actions.

The wayside device may communicate a hazard event notification to one or more remote servers before or without waiting to receive confirmation of receipt of the notification of the hazard event communicated from the wayside device to the controller. In this circumstance, the controller may validate or invalidate the notification of occurrence of the hazard event. The controller may further communicate the validation or invalidation of the notification of occurrence of the hazard event to a remote server.

The wayside device may receive location data from a positioning device, which may or may not be located in or associated with the portion of the track or route of the wayside device. The wayside device may communicate the location of the vehicle group and/or the occurrence of the hazard event to the controller or to a remote server associated with a specified entity or a remote server of a central office associated with the vehicle group. The location data may be sent to the controller or the remote server with the notification of the hazard event. The location data may be sent to the controller or the remote server separate from the notification of the hazard event. The wayside device may facilitate the indirect communication from the controller to the remote server or from the vehicle to the controller and/or the remote server by receiving and transmitting communications.

In one embodiment, a cloud-based remote server may connect to another device and/or system with a separate function at the specified entity. The remote server may form part of, may include, or may be connected to a back-office system (BOS). The BOS may form associations with one or more of the vehicle group, a computer aided dispatch system, and an electronic vehicle group management system, and/or a vehicle network management system. A communication device may be coupled to the remote server.

The remote servers may directly and/or indirectly receive a notification concerning the occurrence of a parameter or condition sensed or determined from the one or more sensors. The remote servers may directly and/or indirectly receive a notification concerning the occurrence of a parameter or condition sensed or determined by the sensor from a controller, an EOT, and/or a wayside device. The remote servers may confirm receipt of a notification received by direct or indirect communication to the remote servers.

When a notification concerning the occurrence of a parameter or condition sensed or determined by the sensor is received by the remote server of the back-office system, the remote server may communicate a hazard event notification to another remote server associated with a specified entity other than the central office associated with the vehicle group. This notification may push an alert to users and first responders who have an alert application installed on their mobile device. The alert may contain a location of the event, a time of event initiation, a type of material transported by the vehicle or vehicle group, an amount of material, and/or recommended actions to take in response to the hazard event. The alert may include information regarding other first responders either at the location of the hazard event or en route. For example, the mobile devices carried by first responders may report locations of the mobile devices to the remote server(s). These locations can be used (e.g., by the remote server) to determine which first responders are located at the event and/or which first responders have headings directed toward the event. A notification of a hazard event communicated by the remote servers may result in a speed restriction so that other operators of vehicles and vehicle groups would be aware of the incident and take appropriately responsive actions. For example, responsive to receiving the notification, a remote server can send a warning signal to the vehicles and vehicle groups headed toward or within a designated distance (e.g., a stopping distance) of the event. This warning signal can instruct the vehicles to manually or automatically reduce speed to no more than an upper speed limit. Optionally, a dispatcher may receive the notification of the hazard event and communicate the speed restriction.

The specified entity other than the central office associated with the vehicle group may be determined based on the circumstances of the hazard event. By way of a non-limiting example, a notification of the hazard event may be communicated to the remote server, and the remote server of the back-office system may be configured to determine one or more specified entities to contact, and communicate a notification of the hazard event to one or more other remote servers associated with the one or more other specified entities. When the remote server communicates a hazard event notification to one or more other remote servers associated with a specified entity other than the central office associated with the vehicle group, the remote server may communicate to the specified entity by other methods, such as phone calls, text messages, simple network management protocol (SNMP) messages, or the like.

The remote server may communicate the notification of the hazard event to a remote server of another specified entity before or after validation or invalidation or without validation or invalidation. The occurrence of the hazard event may be validated before communicating the notification of the hazard event to a remote server associated with a specified entity. In the case that the occurrence of a hazard event is neither validated nor invalidated, the remote server may communicate the notification of the hazard event to another remote server associated with a specified entity.

One or more of the remote servers may validate or invalidate the occurrence of a hazard event based at least in part on communicating with an operator of a vehicle in the vehicle group and/or by comparing and contrasting other information. Other suitable validation information may include the receipt of a notification of the vehicle parameter or condition or the route parameter or condition.

In one embodiment, the remote server may validate or invalidate the occurrence of the hazard event. That is, the sensor might detect a possibly hazard event, and the next step is to confirm the occurrence before further response is taken. The validation, or invalidation, may be based at least in part on communications with an operator of a vehicle involved in the hazard event. The remote server may request validation or invalidation from the operator via an input device. If validation of the occurrence of the hazard event is received via the input device, then the remote server may communicate a notification of the hazard event to a remote server associated with a specified entity. If no validation or invalidation of the occurrence of the hazard event is received via the input device, which may result due to the unavailability of the operator, then the remote server may communicate a notification of a hazard event to another different remote server associated with a specified entity.

The remote server may receive a notification of an occurrence of a hazard event from an operator of the vehicle group via an input device associated with the locomotive or the operator without receiving a notification concerning the occurrence of a parameter or condition sensed or determined by the sensor. The remote server may further communicate the notification of the hazard event to another remote server of another specified entity. By way of example, if a vehicle sensor senses a sudden stop indicative of an impact the system may attempt to communicate with the operator. If the operator responds there was no crash, the system does nothing. Otherwise, the system dispatches a repair and rescue and routes other vehicles around the location. If there is no response from the operator, the system dispatches emergency medical support.

One or more of the remote servers may receive a notification of a hazard event from an EOT or a wayside device. The notification may be received before or after validation of the occurrence of the hazard event.

One or more of the remote servers may compile and/or store a database of hazard event categories. The hazard event categories may include but are not limited to any hazard event category that is required, encouraged, and/or accepted by a specified entity. Specified entities may include a federal government authority, a state government authority, a local government authority, a central office associated with the vehicle group, a central office associated with another vehicle group, a central office associated with a vehicle that is in a mixed group, a maintenance entity, a medical entity, a search and rescue entity, a state police, a local police, an agency related to homeland security, or a combination of two or more thereof. Hazard event categories may include one or more of a vehicle collision event, a vehicle derailment event, a vehicle component failure, damage to a route, blockage of a route (by the vehicle or by another obstacle), or one of the foregoing that has occurred to another vehicle in the vehicle group or another route that is proximate to the instant route. For example, a derailment may block not only the tracks that a train is on, but also a set of routes running alongside.

The controller may determine the specified entity to be contacted based at least in part on the category of the hazard event. The remote server associated with the back-office system of the vehicle group may communicate an identity of the hazard event with the notification of the hazard event, or the identity of the hazard event may be sent separately.

One or more of the remote servers may include a database of determined hazard event severity categories. The severity categories may include any severity category that is required, encouraged, and/or accepted by a specified entity, such as a federal government authority, a state government authority, a local government authority, a central office associated with the vehicle group, another vehicle group, a central office associated with another vehicle group, a maintenance entity, a medical entity, a search and rescue entity, a state police, a local police, an agency related to homeland security, or a combination of two or more thereof. For example, a severity may be based on a number of vehicles involved and affected by the hazard event, a location of the hazard event, a type of route at the location of the hazard event, a grade of the land at the location of the hazard event, and/or a proximity to persons and/or structures potentially affected at the location of the hazard event. The severity may be based on a number of vehicles affected by the hazard event, which may be determined by a number of sensors sensing or determining the at least one parameter or condition. The severity may be based on whether a vehicle remains upright, such as after a collision, which may be determined by a sensed parameter or condition. The remote server may determine the specified entity to be contacted based on an identified severity of the hazard event. The remote server associated with back-office system of the vehicle group may communicate the severity of the hazard event with the notification of the hazard event, or the severity of the hazard event may be sent separately.

One or more of the remote servers may receive location data from the positioning device, which may be located in or associated with the vehicle. The remote server may determine the specified entity to be contacted based on the location of the occurrence of the hazard event. The remote server may communicate the location of the vehicle, the vehicle group and/or the occurrence of the hazard event to another remote server associated with another specified entity. The location data may be sent to the other remote server with the notification of the hazard event or may be sent separately.

One or more of the remote servers may include a database of determined communications to be made in the event of a hazard event. The database of determined communications to be made may include any communication that is required, encouraged, and/or accepted by a specified entity, such as a federal government authority, a state government authority, a local government authority, a central office associated with the vehicle group, another vehicle group, a central office associated with another vehicle group, a maintenance entity, a medical entity, a search and rescue entity, a state police, a local police, an agency related to homeland security, or a combination of two or more thereof. The database of determined communications may include contact information for vehicle owners, insurers and first responders so that appropriate parties within the location of or for the category and/or severity of the hazard event are contacted in the event of a hazard event.

The database of determined communications may be used to determine the specific entities to be contacted based one or more parameters or conditions related to the hazard event. This may include the category of the hazard event, the severity of the hazard event, and/or the location of the hazard event. One or more of the remote servers may include an event log in the form of a data storage device and/or system. The event log may record the occurrence of a parameter or condition sensed or determined by a sensor, a notification based on a parameter or condition sensed or determined by a sensor, a validated hazard event, an invalidated hazard event, and/or a notification of a hazard event received from an operator of the vehicle group via an input device.

One or more of the remote servers may include a materials storage log or manifest in the form of a data storage device and/or system. The materials storage log may record the type of hazard materials being transported, how much of the materials is being transported, and/or how to properly respond to the hazard event for the given hazard material. The remote server associated with a central office that is controlling the vehicle group may communicate at least a portion of the materials storage data with the notification of the hazard event, or the portion of the materials storage data may be sent separately. Note that as used herein "sent" may include posting for retrieval. That is, information may be posted to an electronic site accessible by a user who retrieves it from that site.

The hazard alert system may include a web portal. The web portal may be an interface through which users may define actions and configure the interface and script the interaction. The web portal may display alerts and report events. The contents of the push notifications may depend at least in part on the role of the users, such as whether the users are associated with a vehicle group or with a first responder.

Figure 2:
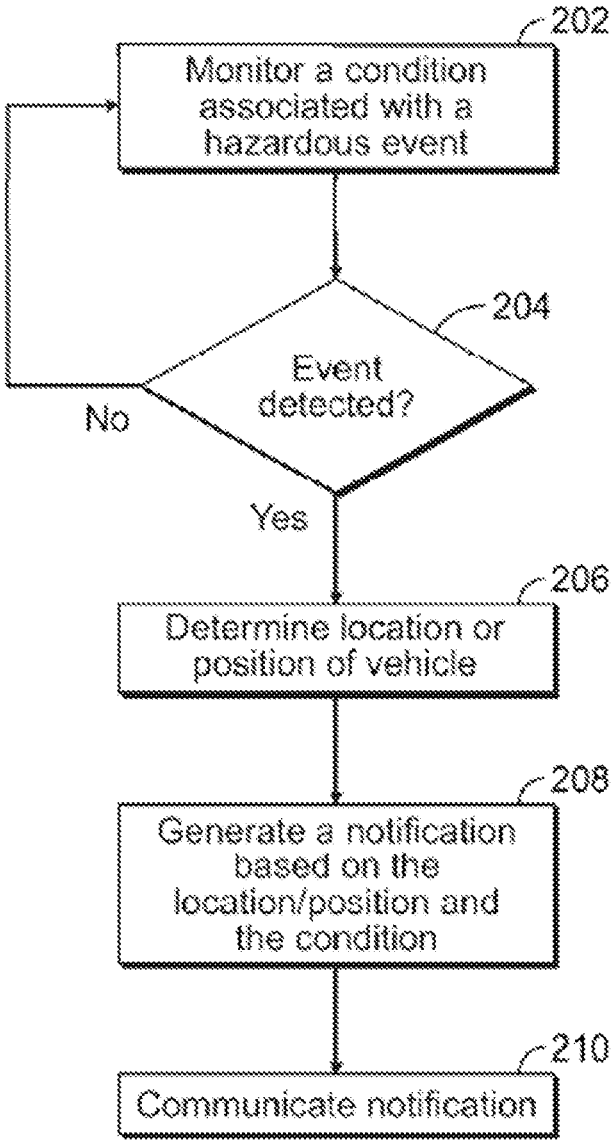
FIG. 2 illustrates a flowchart of a hazard event alert method.

FIG. 2 illustrates a flowchart of a hazard event alert method. The flowchart can represent operations performed by the hazard event alert system, such as the actions performed by and/or under direction of the controller. At 202, at least one parameter or condition associated with a hazard event is monitored. At 204, the data representing the parameter or condition is processed to detect occurrence of the hazard event. If the hazard event is not detected, the method can return toward 202 so that the parameter or condition can continue to be monitored.

If the hazard event is detected, the method can proceed toward 206. At 206, the location or position of the vehicle is determined. Since a hazard event was previously detected, the location or position of the vehicle may be the location or position of the hazard event or may indicate the location or position of the hazard event. At 208, a notification is generated based on the parameter or condition and the location or position of the vehicle. At 210, the notification is communicated to a back-office server, a specified entity, or any other remote server and/or device.

Figure 3:
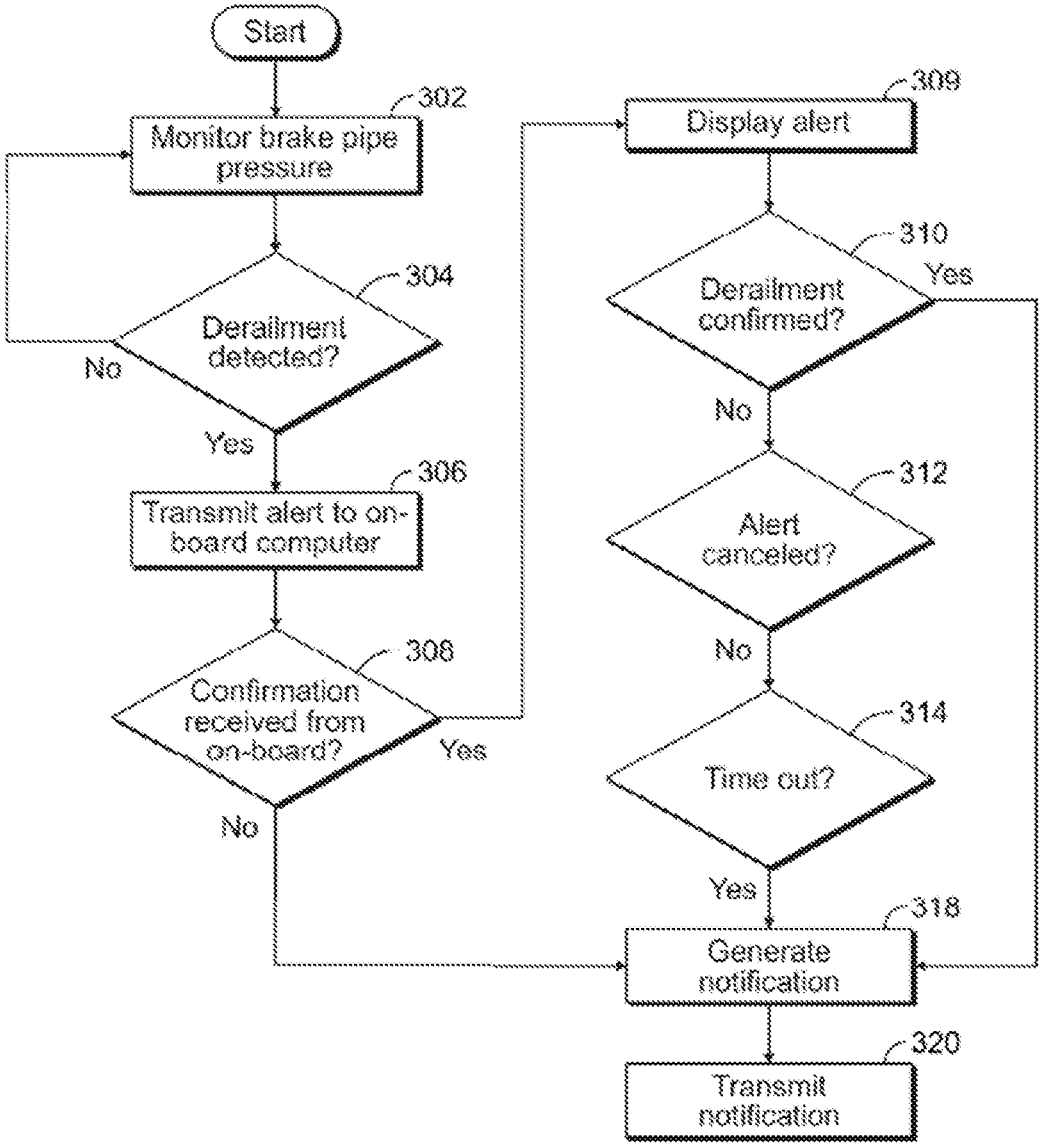
FIG. 3 illustrates another flowchart of a hazard event alert method.

FIG. 3 illustrates a flowchart of another hazard event alert method. The flowchart can represent operations performed by the hazard event alert system, such as the actions performed by and/or under direction of the controller. At 302, a brake pipe pressure is monitored at an EOT of a vehicle group. Other parameters or conditions may be monitored by other devices and systems. At 304, it is determined whether a hazard event (e.g., derailment) has been detected based on the monitored brake pipe pressure. An alert is communicated to the controller at 306. After the alert is communicated to the controller, a determination is made at 308 as to whether a confirmation was received from the controller in response to the alert. If a confirmation is not received, the end-of-vehicle group computer may assume that a communication error has occurred due to a derailment or other hazard event and the method may proceed toward 318. At 318, a notification is generated. At 320, the notification is communicated. The hazard event notification may include various types of information including, for example, the detected parameter or condition, the position or location of the vehicle group, the type of hazard material being transported, a date and/or time, an identification of the vehicle group and/or locomotive, and/or any other information available to the controller, end-of-vehicle group computer, or head-end-unit.

The method may compare other sources of information to collaborate the hazard event. If there are two sensors, for instance, and only one registers an impact the system may choose to heighten the evaluation of the validity of the hazard event. Similarly, if two vehicles are known to be in proximity, notices may check with the second vehicle to see if the second vehicle: collided with the first vehicle, noticed a hazard event, or was otherwise similarly involved in the hazard event as well.

If a confirmation is received from the controller at 308, the method can proceed toward 309 and an indication of an alert is presented (e.g., visually and/or audibly) to an operator of the vehicle group. The indication may present the operator with one or more options. The operator is provided with an option to confirm the hazard event or parameter or condition and an option to cancel the alert (e.g., invalidate the hazard event or parameter or condition). At 310, a determination is made as to whether the operator confirmed the occurrence of a derailment or other hazard event. If a confirmation is received from the operator, the method can proceed toward 318 and a hazard event notification is generated.

If a confirmation is not received at 310 and the alert is cancelled (e.g., at 312), the method may end or, in some non-limiting embodiments or aspects, may proceed to 318 to generate the notification. However, in such circumstances, the notification transmitted at 320 may be transmitted to only a back-office system and other transmissions may be limited or not occur at all.

For example, if a derailment is confirmed at 310, the notification generated at 318 may be communicated at 320 to a back-office server, to various mobile devices, and to a specified entity (e.g., a governmental or regulatory agency). However, if the derailment is not confirmed at 310 and the alert is cancelled at 312, the notification generated at 318 may be communicated to only the back-office system and one or more mobile devices for recordation or other purposes, but not to the specified entity. If the derailment is not confirmed at 310 and the alert is not cancelled at 312, then a determination is made at 314 as to whether a determined time period has lapsed. If the time period has elapsed without a response from the operator of the vehicle group, it may be assumed as a default that a hazard event has occurred and the method can proceed toward 318 and 320. In this circumstance, the notification generated at 318 may be communicated to the back-office system, various mobile devices, and/or a specified entity, as an example.

In one embodiment, a hazard event alert system is provided that includes at least one sensor positioned on or associated with the vehicle group and configured to sense or monitor at least one parameter or condition; at least one communication device positioned on or associated with the vehicle group and programmed or configured to receive, process, and/or transmit data; at least one positioning system programmed or configured to detect a location or position of at least a portion of the vehicle group; and at least one computer positioned on or associated with the vehicle group and in communication with the at least one sensor, the at least one communication device, and the at least one positioning system, wherein the at least computer is programmed or configured to: determine that a hazard event occurred based at least partially on data generated by the at least one sensor; determine or receive the location or position of the at least a portion of the vehicle group from the at least one positioning system; generate a hazard event notification based at least partially on the at least one condition and the location or position of the at least a portion of the vehicle group; and communicate the hazard event notification to at least one of a back-office system and at least one remote server associated with at least one specified entity.

A computer-implemented hazard event alerting method is provided. A parameter or condition associated with a hazard event is detected, as well as a position or location of the vehicle group with the at least one positioning system. The hazard event occurrence may be based at least partially on a determination that a manual confirmation input is received from the operator of the vehicle group, a manual confirmation input is not received from the operator of the vehicle group within a determined time period, or a communication error between a controller and at least one of an end-of-vehicle group computer and the at least one sensor, or a combination thereof. A hazard event notification may be generated based at least partially on the at least one condition and the position or location of the vehicle group; and transmitting the hazard event notification to at least one remote server.

A hazard event alert system includes at least one sensor positioned on or associated with the vehicle group and configured to sense or determine at least one condition associated with a hazard event; at least one communication device positioned on or associated with the vehicle group and programmed or configured to receive, process, and/or transmit data; at least one positioning system programmed or configured to sense or determine a location or position of at least a portion of the vehicle group; and at least one computer positioned on or associated with the vehicle group and in direct or indirect communication with the at least one sensor, the at least one communication device, and the at least one positioning system. The at least one computer may: generate or receive a notification based at least partially on the at least one condition sensed or determined by the at least one sensor; determine or receive a location or position of at least a portion of the vehicle group based at least partially on the location or position sensed or determined by the at least one positioning system; and communicate a notification of a hazard event to at least one of the following: a controller located in or associated with the at least one locomotive of the vehicle group; an end-of-vehicle group computer located in or associated with at least one railcar of the vehicle group; a remote server associated with a specified entity; or any combination thereof.

In one embodiment, a method includes identifying a blocked or damaged location and responding thereto. The blocked or damaged location may be an intersection, or a determined segment of a route, or segments adjacent thereto. Blocked may refer to an object that would interfere with travel through the location, and may include total blockage or partial blockage. An example of total blockage may be a rockslide that cover the route, or a stalled or incapacitated vehicle. Partial blockage may be snow, water, leaves or foliage. It may be possible to navigate a partially blocked location (or not) in a non-standard operating mode other than a normal operating mode. Suitable non-standard operating modes may include slower travel than a speed limit might permit, use of a lower speed higher torque gear set, driving onto a shoulder or through a detour, and the like.

The method may be implemented with a blocked crossing detection and notification system that includes a controller (which includes at least one processing device), a communications interface communicatively coupled to the controller and a detection system. The controller may facilitate communications between the controller and at least one external device. The detection mechanism may be placed proximate to a location, such as a rail grade crossing or an automobile intersection or a marine vessel crossing lane (e.g., the mouth of a harbor or river). The detection mechanism may communicate with the controller. The method includes periodically operating the detection mechanism. Assessing signals from the detection mechanism to determine the presence or absence of a blockage within a defined area surrounding an intersection of a roadway and a route. And periodically, but not continuously, delivering information regarding the assessed real time presence or absence of a blockage to the at least one external device at a location remote from the defined area. A monitoring organization may receive the assessed presence or absence of the potential blockage at the location remote from the defined area and may analyze an assessed blockage in real time and execute a commensurate response. The assessment may include a degree of blockage, a type of blockage, or simply the presence or absence of the blockage.

In one embodiment, a hazard event alert system includes at least one positioning system programmed or configured to detect a location or position of a vehicle or a portion of a vehicle group that includes the vehicle. The system also includes at least one sensor positioned on or associated with the vehicle and configured to generate sensor data of a determined parameter or condition. The system also includes a controller in communication with the sensor and the at least one positioning system. The controller is programmed or configured to determine that a hazard event has occurred or is predicted to occur based at least partially on the sensor data and to communicate a hazard event notification to a remote server based at least in part on the location or position that is detected and the sensor data.

The controller can be configured to communicate the hazard event notification to one or more of a federal government authority, a state government authority, a local government authority, a maintenance entity, a medical entity, a search and rescue entity, a state police, a local police, and/or an agency related to homeland security. The authority, police, or agency receiving the notification can then dispatch or otherwise appropriately respond to the hazard event being detected.

The at least one sensor can include one or more of a rotational sensor, a gyroscope, an accelerometer, a pressure sensor, a thermocouple, a smoke detector, or a combination of two or more thereof. Optionally, the at least one sensor can include a pressure sensor adapted to monitor brake pipe pressure, and the end-of-train device can be in communication with the pressure sensor and programmed or configured to determine that the hazard event has occurred based on a change in the brake pipe pressure.

The vehicle can be a locomotive, the vehicle group can be a train, and the controller can be an end-of-train device, head-end unit, or a head-of-train device.

The controller can be configured to respond to a determination that the hazard event has occurred or is predicted to occur by displaying an alert to an operator of the vehicle. The controller can be configured to receive an input from the operator confirming or invalidating occurrence or prediction of the hazard event. For example, the operator may have additional information or insight on whether the hazard event actually occurred and/or whether the conditions indicate that the hazard event actually occurred. The operator can refute or confirm the hazard event using this additional information or insight and respond accordingly to avoid or reduce false-positive detection events.

The controller can be configured to direct communication of the hazard event notification to the remote server in response to determining one or more of a requested input from an operator of the vehicle is not received by the controller within a determined time period, the requested input from the operator confirming occurrence of the hazard event, and/or a communication error occurred with the controller. For example, if the controller does not receive input from an operator that confirms or refutes that the hazard event occurred or is likely to occur (e.g., within a designated time period of receiving the sensor data), then the controller can communicate the notification as a safeguard or default action. This can prevent operator inattention or delay, operator mistake, or communication errors from stopping communication of the notification. As another example, the controller can be configured to selectively notify a specified entity with the hazard event notification based at least partially on the location or position of an occurrence of the hazard event, a category of the hazard event, a severity of the hazard event, and/or an identity of a material being transported by the vehicle or the vehicle group.

The controller can be configured to communicate with a vehicle location server and obtain one or more of a vehicle location and a time at which the vehicle location was reported. This server can be a BOS as described herein.

The sensor may be a tilt sensor and the controller can be configured to dispatch (or order dispatch of) a repair and maintenance crew to the location of the vehicle in response to the tilt sensor indicating that the vehicle is not upright. As another example, the sensor can be a smoke detector and/or a fire detector, and the controller can be configured to dispatch a fire fighting crew to the location of the vehicle in response to the fire detector detecting fire or the smoke detector detecting smoke.

Also provided herein are a system, method, and apparatus for determining a location of a vehicle system, such as the location of the end of the vehicle system. The vehicle system can be formed from one vehicle, or two or more vehicles that are mechanically or logically coupled. Logically coupled vehicles include vehicles that communicate with each other to coordinate movements of the vehicles with each other so that the vehicle travel together as a group, even though the vehicles may not be mechanically connected with each other. The vehicle system can be a train formed from rail vehicles, or may be formed from other types of vehicles, such as automobiles, trucks, marine vessels, aircraft (e.g., manned or unmanned, drones, etc.), agricultural vehicles, mining vehicles, or other off-highway vehicles.

The system can include a plurality of passive transponders located throughout a route network that each include transponder data uniquely identifying a route segment or location where the transponder is positioned, such as, but not limited to, a portion of a route, a switch, a region, coordinates, and/or the like. The transponder data may be any type of data that uniquely identifies a route segment or location and, in a preferred and non-limiting embodiment, includes a unique identifier that can be correlated with a route location from a route database. Moreover, the transponders may be located anywhere throughout a route network and may be located adjacent a clearance point of a switch or adjacent a route segment approaching a clearance point of a switch. However, it will be appreciated that transponders may be positioned at other locations throughout the route network to control movement of multiple vehicle systems by establishing boundaries that may be used to hold vehicle systems in a particular location for traffic control or the like.

A vehicle system can include an end-of-train (EOT) device arranged on an end of the vehicle system (e.g., on an end of a rear railcar) that includes a signal receiving device. The passive transponders and signal receiving device are configured such that when a train is traveling on a route, the signal receiving device activates and receives data from the stationary transponders. Thus, the transponders may be located on the route, adjacent the route, or in sufficient proximity to the route such that the signal receiving device is able to communicate with them. Using the transponder data stored on the transponders, an on-board computer on the vehicle system and/or the EOT device determines a location of the train and, particularly, a location of an end of the vehicle system relative to the route. By using passive transponders rather than active wayside equipment, less maintenance is required.

Also provided are a method and system for transmitting enforceable instructions in vehicle control systems such as PTC. The system and method verify geographic back office server (G BOS) normalization and vehicle system association of enforceable instruction data. The system and method generate data used by an on-board system to ensure that the G BOS delivers correct enforceable instruction data to the correct vehicle systems. The system and method can create multiple types of error-checking codes used to ensure each enforceable instruction is correct when received by a vehicle system and to ensure that the vehicle system has the correct set of enforceable instructions. The enforceable instructions include mandatory directives, permissive enforceable instructions, restrictive enforceable instructions, enforceable instructions to a vehicle system, or any combination thereof.

The method and system can communicate enforceable instructions that mitigate hazards that could occur in the transmission of the enforceable instructions from dispatch systems through a BOS to a vehicle system. Preferably, provided is a method and system for transmitting enforceable instructions in PTC systems that affect a PTC Office-Locomotive interface control document (ICD) and an on-board system and BOS segments of the PTC system, as well as introduces improved components to the BOS segment.

The method and system can ensure electronic delivery of an enforceable instruction (authority or bulletin) to the correct vehicle system and that the enforceable instruction is intact (e.g., not changed from when the enforceable instruction was generated by a dispatch system). This can obviate the need for redundant BOS segments to provide safety assurance and protection against hardware and software errors is obviated.

One or more additional embodiments of the subject matter disclosed herein relate to systems and methods that can detect a hazard event and report the hazard to vehicles. The hazard event can be detected by components onboard a first vehicle and a warning signal can be communicated from the first vehicle to one or more second vehicles that are proximate to (e.g., within a threshold distance, such as ten kilometers) the hazard. Optionally, the warning signal can be communicated to a wayside device that then communicates the warning signal (or another signal based on the warning signal) to the second vehicle(s). The first vehicle and/or the second vehicles can change an operational mode of the vehicle(s) responsive to receiving the warning signal from another vehicle or from the wayside device. For example, the vehicle(s) can change an operational mode by slowing down, stopping, changing which route(s) the vehicle(s) travel upon, etc., to avoid the hazard.

In one embodiment, the hazard event that is detected and for which the vehicles are warned is a rockslide or landslide. For example, a first vehicle moving in a mountainous or otherwise rocky area can detect a rockslide or a wayside device disposed on a mountain or side of a road can detect the rockslide. The first vehicle and/or wayside device can communicate the warning signal notifying others of the rockslide. This can help the other vehicles avoid colliding with the rocks.

The sensor may be positioned on or associated with at least one vehicle in a group of vehicles. One example of a group of vehicles that may be coupled together is a train that includes one or more locomotives and railcars, and in which the vehicles are both mechanically and communicatively coupled. Another example is a platoon of on-road vehicles or aerial drones that may only be communicatively coupled. For example, communicatively coupled vehicles includes vehicles that are not mechanically coupled but that communicate with each other during movements of the vehicles so that the vehicles can coordinate their movements with each and move along one or more routes as a group of vehicles. A vehicle group of a single vehicle is referred to herein simply as a vehicle, and the vehicle group may include one or more vehicles that are at least communicatively coupled such that movement of the group of vehicles is coordinated via the communicative coupling.

Examples sensors include an accelerometer, a pressure sensor, a thermocouple, a microphone, a camera, and a rotational sensor. A sensor system may include a housing, and a wireless communicator. The sensor system may include a power source, such as a battery, a solar cell, a piezoelectric shaker, and the like. In one embodiment, the sensor may communicate with another sensor to pass messages along to a controller, an EOT, a wayside device, and/or a remote server. The sensor may report that at least one parameter or condition associated with a hazard event has been sensed or determined.

A sensor may sense, measure or determine a parameter or condition associated with a hazard event. The parameter or condition may be associated with one or more vehicles in the vehicle group, or the route, or wayside equipment that is proximate to the route, or an inspection unit that is inspecting a portion of the route or the vehicle, or area or environmental information systems (such as weather alerts or emergency broadcasts). When referring to the route, adjacent and proximate route considerations are included. Examples of vehicle related parameters or conditions associated with a hazard event include an acceleration event, a deceleration event, a brake pipe pressure, a vibration, a tilt of a vehicle, a vehicle speed, a vehicle component temperature, and/or other like conditions or parameters. Other suitable conditions or parameters may include the deployment of an airbag, an optical signal, a lidar or radar signal, an acoustic event, deployment of brakes, a waveform signal generated by a traction motor (or the loss thereof), a battery charge level, a battery temperature level, smoke detection, gas leak detection, fuel leak detection, and lubricant leak detection. Acoustic events may include a determined sound profile configurable from a gunshot, the sound of breaking glass, a human voice, sirens, and the like.

The sensors located at or associated with a vehicle may form part of, may include, or may be connected to a controller, an EOT, a wayside device, a remote server, and/or a positioning device. A sensor may be attached or installed on a vehicle or vehicle accessory, such as a semi-truck, trailer, automobile, marine vessel, locomotive, a railcar, EOT, mining equipment, aircraft, or other vehicle of the vehicle group.

A suitable sensor system may have a fastener. Suitable fasteners may include a magnetic or adhesive pad on its housing or a mechanical clamp. In one embodiment, the sensor may include a mobile or stationary device that has capabilities for sensing or determining a vertical and/or lateral acceleration and/or other movement of the vehicle.

The communication device may be onboard a vehicle in the vehicle group. The communication device may receive, process, and/or transmit data. The positioning system may sense or determine a location or position of a vehicle in the vehicle group, and by extension, the vehicle group itself. The controller may be positioned in or associated with a vehicle in the vehicle group. The controller may communicate with the sensor, the communication device, and the positioning system. The controller may generate or receive a notification based at least partially on the parameter or condition sensed or determined by the sensor. The controller may determine or receive a location or position of at least a portion of the vehicle group based at least partially on the location or position sensed or determined by the at least one positioning system. The controller may communicate a notification of a hazard event between the computers, to a remote server associated with a specified entity, to a back-office system (BOS), an emergency management service, or a combination of two or more thereof. In one embodiment, the controller may be an on-board computer. Suitable on-board computers may include a vehicle controller, an end-of-train (EOT) device, an Edge device (such as EdgeL-INC™ from Wabtec Corporation) and the like.

FIG. 1 shows the hazard event alert system 1000. The system is an example for a railroad scenario and includes a vehicle group 10 that is a train. The train includes a first vehicle 12 that is a locomotive and one or more additional vehicles 14 that are railcars. A controller may be located in or associated with the locomotive. The first vehicle can be referred to as a propulsion-generating vehicle (e.g., automobile, locomotive, truck, agricultural vehicle, mining vehicle, marine vessel, etc.) while the additional vehicles can be referred to as non-propulsion-generating vehicles (e.g., railcars, trailers, barges, etc.). While a rail vehicle system is shown in FIG. 1, the system 1000 may be used in connection with other types of vehicles.

The controller may form part of, may include, or may be connected to another device and/or system with a separate function in the propulsion-generating vehicle. The other functional device may be, for example, an Energy Management System (EMS), a network management system, a Positive Train Control (PTC) system, a head-end-unit (HEU) system, a Head-of-Train device (HOT), a vehicle group (e.g., consist) management computer, a distributed power system (such as LocoTROL™ from Wabtec Corporation), a route manager and vehicle dispatch system, and/or a locomotive cab unit system. In one embodiment, the controller is a separate device or system relative to the vehicle on which it is disposed rather than integrated with a system that is dedicated to another function.

Suitable controllers may be a stationary device or a mobile device, such as an application-specific integrated device or a mobile device. Suitable mobile devices may include wearable electronics, a smartphone, laptop, or tablet computer. In one embodiment, the processing and control device is an edge-based computing device. The controller may communicate with one or more EOT devices, one or more wayside devices, one or more remote servers, one or more sensors, and/or one or more positioning devices. In one embodiment, the controller is part of the EOT.

Suitable remote servers may include a cloud-based computing platform. Depending on the application, wired and wireless communication may be used and the various devices, including the controller, may communicate via one or more communication devices. As an example of wired communication, communication may be performed using a vehicle power line running from the lead to the rear of a group of mechanically coupled vehicles. In one embodiment, the sensors may communicate with the EOT, controller, and/or remote servers.

The controller may receive a notification (e.g., an alert or other message) concerning the occurrence of one or more parameters or conditions sensed or determined from a sensor. In various embodiments, the notification may come from an onboard device (e.g., the EOT device) and/or an off-board device (e.g., a wayside device). The controller may confirm receipt of a notification received from the EOT and/or the off-board or wayside device. In one embodiment, the wayside device is a portable, person-carried device. In another embodiment, the wayside device is a permanently or semi-permanently installed device proximate to the route or a feature on the route (such as an intersection, bridge, switch, and the like).

A wayside device may include one or more transponders, transceivers, or other information transmitter. The transponder may be powered or may be passive depending on the application specific parameters. In one embodiment, there may be a plurality of passive transponders located throughout a vehicle route network, where each includes transponder data uniquely identifying a route segment or location where the transponder is positioned. The positioning may be strategic, such as proximate to a determined portion of a track, a switch, a region's boundary, determined coordinates, and/or the like. The transponder data may include an identifier that is correlated with a location stored in a route database or a map. Moreover, the transponders may be located throughout the route network, including adjacent to an intersection or a clearance point of a switch, or adjacent a route segment approaching a clearance point of a switch or intersection. The system may be used or coordinated with the control and movement of a vehicle, or a group of vehicles, by establishing boundaries or geofences that may be used for traffic control or the like.

A suitable transponder may be a passive radio frequency identification (RFID) transponder (e.g., tag) and signal receiving device may be an RFID reader that energizes the transponder to retrieve data stored thereon. Other suitable transponders may include a near field communication (NFC) tags, low-power Bluetooth® devices, and/or the like. In one embodiment, the sensor is an optical sensor that can interact with, for example, one or more printed data sources (e.g., a two- or three-dimensional barcode, a visual code, printed text, etc.). In such examples, the sensor (or a complimentary device) may illuminate the printed data source (e.g., with an infrared light or another light source) and capture the data printed thereon as an image capture device. The controller may then decode and/or process the captured image to obtain the data encoded or printed thereon.

During operation, a notification concerning an occurrence of a parameter or condition sensed or determined by the sensor may be received by the controller. The controller may communicate a hazard event notification to a remote server associated with a specified entity associated with a governmental agency, regulatory agency, or some other authority or entity, and/or a remote server of a back-office system (BOS) (e.g., a central office associated with the vehicle group and/or responsible for a route network). In one embodiment, the controller may directly communicate a hazard event notification to the remote server.

The controller may communicate a hazard event notification to a remote server associated with a specified entity other than the BOS associated with the vehicle group, and the controller may communicate to such specified entity by other methods. Other suitable methods may include one or more of phone calls, text messages, push notifications, and/or the like. The controller may communicate with the remote server and/or back-office system instead of or in addition to the controller, or when the controller is out of communication with the controller.

The controller may communicate the notification of the hazard event to the remote server of the BOS associated with the vehicle group or the route network (or both), and the remote server may communicate the notification of the hazard event to one or more other remote servers associated with one or more specified entities. The remote server may communicate the notification to other vehicles or vehicle groups that are proximate to the location or position of the hazard event. The remote server may communicate the notification to other vehicles or vehicle groups that are distant from the location or position of the hazard event, but are traveling toward or scheduled to travel toward the location or position of the hazard event. The remote server may selectively notify based on determined factors. Suitable factors may include the amount of elapsed time between the occurrence of the hazard event and the approach of the other vehicles, whether the other vehicles are traveling on the same route as the hazard event (same tracks or same lane of a road) or merely proximate to (a nearby set of tracks, or the other side of a multi-lane road), the type of hazard event, the nature of any cargo spilled, the types of vehicles involved, the time of day or time of year, weather and environmental conditions, and whether a response team has arrived at the location or position of the hazard event.

The remote server of the specified entity may be selectively determined based on the circumstances of the hazard event. The controller and/or EOT may communicate a notification of the hazard event to a remote server associated with a specified entity other than the central office associated with the vehicle group in addition to or instead of communicating a notification of the hazard event to a remote server of the BOS associated with the vehicle group.

A notification of a hazard event communicated by the controller may push an alert to users and first responders who have a software application installed on a mobile device. The alert may contain a location of the event, a material transported by the vehicle (e.g., as may be determined based on operator input to the controller, from a manifest provided to the controller, from an optical scan of indicia associated with the material container, etc.), an amount of material, media (e.g., photographs, images, and/or video), and/or recommended actions to take in response to the hazard event. A notification of the hazard event communicated by the controller and/or EOT may include audio, graphic and/or video information. Audio and/or video information may be received via an input device associated with the controller, EOT, or a mobile device and displayed thereon. As an example, the audio and/or video information may be captured by a camera and/or microphone in communication with the controller and/or EOT. It may be captured by an operator of the vehicle or crewmember with a mobile device having a camera and/or microphone.

A notification of the hazard event communicated by the controller may result in a route designation that a hazard event may exist, or will exist (e.g., the vehicle is headed toward a fire, collision, obstacle, etc.), in a determined location. Hazard event information may then be disseminated to other vehicles and vehicle groups and/or operators of such vehicle groups who can then adjust and respond accordingly.

In one embodiment, the hazard event may be a predicted event. The hazard may not have occurred yet, but the sensed conditions and/or locations may indicate that the hazard event is likely to occur. For example, the controller can examine the locations of vehicle groups and the sensed conditions to determine that the vehicle groups are headed toward each other, are headed toward an obstacle, are headed toward another impassable situation (e.g., a washed out bridge), etc. Even though the hazard involving the vehicle group(s) has not yet occurred, the sensed conditions and locations indicate that the hazard event is more likely than not to occur. The controller can then communicate the notification to warn those vehicle group(s), other vehicle groups, the dispatcher, wayside devices, etc., of the predicted impending hazard event.

The controller may communicate the notification of the hazard event before or after validation or invalidation, or may communicate the notification without validation or invalidation. For example, in response to detecting a parameter or condition, an operator of the vehicle group may be presented with an indication of the alert with options to validate (e.g., confirm) or invalidate (e.g., cancel) the alert. The controller may communicate the notification of the hazard event to a remote server associated with the back-office system before validation or invalidation, and may communicate the notification to the remote server associated with a specified entity after the alert is verified or after a determined time period elapses without any input being received from the operator of the vehicle group. It will be appreciated that the notification may be communicated to the remote server associated with the back-office system after validation or the expiration of the determined time period.

The controller may communicate the notification of the hazard event to a remote server of the BOS associated with the vehicle group before validation or invalidation, and may again communicate the notification of the validated hazard event to the remote server of the BOS and/or to another remote server associated with a specified entity other than the central office associated with the vehicle group. By way of another non-limiting example, the controller may wait for validation or invalidation before communicating the notification of the hazard event to a remote server associated with a specified entity and the remote server of the back-office system associated with the vehicle group and/or to another remote server associated with another specified entity.

After invalidation of the occurrence of the hazard event, the controller may still communicate the notification of the invalidated hazard event to the remote server of the back-office system associated with the vehicle group for recordation or other purposes.

In the case that the occurrence of a hazard event is neither validated nor invalidated within a determined time period, the controller may communicate the notification of the hazard event to a remote server of the back-office system associated with the vehicle group and the remote server associated with a specified entity other than the back-office system associated with the vehicle group.

The controller may communicate the notification of the hazard event to a remote server of a back-office system associated with the vehicle group before validation or invalidation, and after the hazard event is neither validated nor invalidated within a determined time period, the controller may communicate the notification of the unconfirmed hazard event to the remote server of the back-office system associated with the vehicle group and/or to another remote server associated with another specified entity.

The identity of the hazard event may be sent to the remote server with the notification of the hazard event, or the identity of the hazard event may be sent separately. In one embodiment, the remote server may obtain information from social media sources that relate to the hazard event. For example, text, pictures, or video of a hazard event may be posted on publicly available websites or mobile device applications, private websites or mobile device applications, or the like, where people can share the text, pictures, and/or video. If this posted information is stamped with the proper time and location to correspond with the occurrence of the hazard event the contents may be used to validate the occurrence, then the controller and/or BOS can download the text, pictures, and/or video. Further, pictures may be used to help determine the scope or size of the hazard event. The number of related social media posts may be used to help determine an affected population size and/or scope of the area affected by the hazard event.

For validation, the controller may validate or invalidate the occurrence of a hazard event communicating with an operator of the vehicle group and/or by relying on other information. By way of example, a notification of at least one parameter or condition sensed or determined by a second sensor may be used to validate the at least one parameter or condition sensed or determined by a first sensor.

In the case of validating or invalidating the occurrence of the hazard event based on communications with an operator of the vehicle group, the controller may include and/or be in communication with one or more input devices and/or one or more output devices. An input device may include but is not limited to a keyboard, mouse, joystick, audio input, and/or video input. An input device may include a stationary input device and/or a mobile input device. By way of another non-limiting example, the stationary input device may include a mounted microphone and/or mounted camera. The mobile input device may include a handheld phone and/or handheld camera. The input device may include a stationary input device and/or a mobile input device. The static and/or mobile output device may include an audio output device, such as a speaker and/or a display, and/or a video output device, such as a handheld phone or a handheld display. The input device and the output device may be the same or separate devices and/or systems.

The controller may validate or invalidate the occurrence of the hazard event based on communications with an operator of the vehicle group. The controller may validate or invalidate the occurrence of the hazard event by generating a prompt to an operator of the vehicle group via the output device. The controller may further request validation or invalidation from the operator of the occurrence of a hazard event via the input device. If validation of the occurrence of the hazard event is received via the input device, then the controller may communicate a notification of a hazard event to one or more remote servers as described above. If the occurrence of the hazard event is invalidated, then the controller may or may not communicate a notification of an invalidated hazard event to the remote servers and may, in some examples, communicate the notification only to the remote server of the back-office system.

If no validation or invalidation of the occurrence of the hazard event is received via the input device within a determined time period, which may indicate the unavailability of the operator, then the controller may communicate a notification of a hazard event to the remote servers after determined conditions are met, such as a determined amount of time for the operator to validate or invalidate the occurrence of the hazard event. The controller may determine the specified entity to be contacted based on whether the occurrence of the hazard is validated, invalidated, or unconfirmed.

The controller may receive a notification of an occurrence of a hazard event from an operator of the vehicle group via an input device with or without a parameter or condition being previously sensed or determined by a sensor. In this case, the controller may communicate the notification of the hazard event to a remote server of the back-office system associated with the vehicle group and/or may communicate the notification of the hazard event to a remote server of another specified entity.

The controller may include a database of hazard event categories. The hazard event categories may include any hazard event category that is required, encouraged, and/or accepted by a specified entity, such as a federal government authority, a state government authority, a local government authority, a central office associated with the vehicle group, another vehicle group, a central office associated with another vehicle group, a maintenance entity, a medical entity, a search and rescue entity, a state police, a local police, an agency related to homeland security, or any combination thereof. The hazard event categories may include a category for a vehicle collision event, for a vehicle derailment event, for vehicle failure, for route damage, for route congestion, for route blocking, and for predictive (rather than actual) instances of the foregoing. The controller may determine the specified entity to be contacted based on the identity of the hazard event.

The controller may include a database of determined hazard event severity categories. The severity categories may include any severity category that is required, encouraged, and/or accepted by a specified entity, such as a federal government authority, a state government authority, a local government authority, a central office associated with the vehicle group, another vehicle group, a central office associated with another vehicle group, a maintenance entity, a medical entity, a search and rescue entity, a state police, a local police, an agency related to homeland security, or any combination thereof. For example, a severity category may be based on a number of railcars affected by the hazard event, a location of the hazard event, a type of track at the location of the hazard event, a grade of the land at the location of the hazard event, and/or a proximity to persons and/or structures potentially affected at the location of the hazard event. For example, severity categories may be based in part on a number of vehicles affected by the hazard event, which may be determined by a number of sensors sensing or determining an at least one parameter or condition associated with a hazard event. In one embodiment, the severity categories may be based in part on whether a vehicle remains upright (determined from an at least one parameter or condition sensed by a sensor). The controller may determine a specified entity to be contacted based on the severity of the hazard event. The severity of the hazard event may be sent to the remote server with the notification of the hazard event, or the severity of the hazard event may be sent separately.

The controller may receive location data from a positioning device. The positioning device may be located at or associated with a single vehicle of the vehicle group, one or more vehicles of the vehicle group, or a portion of the track. The positioning device may form part of, may include, or may be connected directly to a controller, or to an EOT, a wayside device, a remote server, and/or a sensor. The positioning device may be located in or on one or more vehicles in the vehicle group. Optionally, the positioning device may be off-board the vehicle group (e.g., a stationary sensor that detects presence or passage of the vehicle group by the positioning device (e.g., a camera, infrared sensor, etc.). The controller may determine the entity to be contacted based on the location of the occurrence of the hazard event. The controller may communicate the location of the vehicle group and/or the occurrence of the hazard event to the remote servers. The location data may be sent to the remote servers with the notification of the hazard event, or the location data may be sent separately.

Suitable positioning devices may include one or more of global positioning systems (GPS), axle counters, signal triangulation, wheel tachometers, or other devices that generate output that can be used by the controller to determine or estimate the location of a vehicle or vehicle group. For example, the axle counters may be fixed to a route and count the number of axles passing by the axle counters. An axle counter can be associated with a known location. Responsive to detecting passage of a number of axles associated with a vehicle group, the axle counter can output a data signal that indicates that the vehicle group passed the location of the axle counter. As another example, the wheel tachometers may output signals indicative of how often the wheels or axles are rotating. The controller may be provided with sizes of the wheels and at least one known location of the vehicle or vehicle group. The controller can then calculate a location of the vehicle or vehicle group based on the known location, how many wheel revolutions have occurred based on the wheel tachometer output, and the sizes of the wheels. The positioning device may form part of, may include, or may be connected to a Global Positioning System (GPS) for sensing or determining a location or position of at least a portion of the vehicle group. The positioning device may determine location based on a stationary marker, such as a milepost marker, based on velocity data, and/or based on information received from a wayside device. The positioning devices may communicate with one or more controllers, one or more end-of vehicle group computers, one or more wayside computers, one or more remote servers, one or more sensors, and/or one or more additional positioning devices.

Optionally, the controller can determine the location of the vehicle or vehicle group by communicating with a vehicle location server that is located off-board the vehicle group. The vehicle location server tracks and updates the location of one or more vehicles in a determined area in real-time or near-real-time, although lag may occur in the update process and/or vehicle may lose communication as to prevent updating from time to time. One example of a rail vehicle location server for a rail-based implementation may include a train location server optionally coupled with a positive train control (PTC) system. The train location server may record a latest or current locomotive position of a locomotive equipped with a PTC On-Board System. The update may include information about the track network and locations at which trains in the track network have requested polling. The polling and/or the update may be based on the messages forwarded by a PTC message router. The vehicle location server may forward the train location information including the current locomotive positions and the polling positions of each of the trains (TR) in the track network to each other train (TR) in the track network. The vehicle location server may selectively forward to propulsion-generating vehicles that report operating at restricted speed. For example, the train location information can include the location or position of the train (TR) in the track network, the location or position of at least one locomotive or control car (L) in the track network, the location or position of the at least one railroad car (RC) in the track network, the location or position of a target location, and the location or position of the target with respect to the location or position of the train (TR) in the track network or the location or position of the at least one locomotive or control car (L) in the track network. The target may be a switch location or a track heading change, such as a curve or a hill, or another aspect associated with the track network. Suitable train location information can include current speeds of the trains (TR), current accelerations of the trains (TR), a number of locomotives (L) in the trains (TR), a number of railroad cars (RC) in the trains (TR), a total length of each of the trains (TR), or a combination of two or more thereof, the type of locomotive, the type of railcar, the type of the target, the location of the target, operating parameters of the locomotive(s), environmental conditions at the location, and the presence or absence of a hazard event. The vehicle location server can be queried for, among other things, the location of a vehicle or group of vehicles, and the freshness of the location information—a "last known address" and how long ago the vehicle was known to be at the location.

The controller may access a database of determined communications to be made in the event of a hazard event. The database of determined communications to be made may include any communication that is required, encouraged, and/or accepted by a specified entity, such as a federal government authority, a state government authority, a local government authority, a central office associated with the vehicle group, another vehicle group, a central office associated with another vehicle group, a maintenance entity, a medical entity, a search and rescue entity, a state police, a local police, an agency related to homeland security, or any combination thereof. The database of determined communications may include contact information for railroads and/or first responders.

The database of determined communications may select which of the specific entities to be contacted based on one or more circumstances related to the hazard event. The one or more circumstances may include the category of the hazard event, the severity of the hazard event, and/or the location of the hazard event.

The controller may include an event log in the form of a data storage device and/or system. The event log may record the occurrence of one or more parameters or conditions sensed or determined by a sensor, one or more notifications based on one or more parameters or conditions sensed or determined by the sensor, one or more validated hazard events, one or more invalidated hazard events, and/or one or more notifications of hazard events received from an operator of the vehicle group via an input device, but the event log is not limited thereto.

The controller may include a materials storage log in the form of a data storage device and/or system. The materials storage log may record the type of hazard materials being transported, how much material is being transported, and/or how to properly respond to the hazard event for the given hazard material, but at least a part of the materials storage log is not limited thereto. The materials storage data may be sent to the remote server with the notification of the hazard event or a portion of the materials storage data may be sent separately.

The EOT may form part of, may include, or may be connected to another device and/or system located in or associated with the vehicle. By way of a non-limiting example, another device and/or system may include a smart end-of-vehicle group device that includes a flashing rear-end device, a device and/or system that monitors brake line pressure, a device and/or system that monitors for accidental separation of the vehicle group, and/or a device and/or system that transmits data to the locomotive. The EOT may be a separate device and/or system.

The EOT may include, or communicate with one or more controllers, one or more wayside computers, one or more remote servers, one or more positioning devices, and/or one or more sensors. The EOT may communicate via one or more communication devices 114. The EOT may directly and/or indirectly receive a notification concerning the occurrence of a parameter or condition sensed or determined from a sensor. In the case that a notification concerning an occurrence of a parameter or condition sensed or determined by the sensor may be received by the EOT, the EOT may communicate a hazard event notification to a controller, to a wayside device, and/or to a remote server associated with a specified entity.

In the case that the EOT communicates the notification of the hazard event to the controller, the EOT may receive confirmation of receipt of the notification communicated from the EOT to the controller. The EOT may receive the confirmation of receipt after communicating a request for a confirmation of receipt of the notification to the controller. By way of another non-limiting example, the EOT may receive the confirmation of receipt without or before communicating a request for a confirmation of receipt of the notification to the controller.

If the EOT does not receive confirmation of receipt of the notification of the hazard event communicated from the EOT to the controller, which may result due to the unavailability of the operator, the EOT may communicate a hazard event notification to a remote server associated with a specified entity after determined conditions are met, such as a determined amount of time for the controller to confirm receipt of the notification of the hazard event.

The EOT may communicate a hazard event notification to a remote server associated with a specified entity before or without waiting to receive confirmation of receipt of the notification of the hazard event communicated from the EOT to the controller. A notification of a hazard event communicated by the EOT may push an alert to users and first responders who have an alert application installed on their mobile device. The alert may contain a location of the event, a material transported, an amount of material, and/or recommended actions to take in response to the hazard event.

The EOT may receive location data from the positioning device, which may be located in or associated with a vehicle positioned at the rear of the vehicle group relative to a direction of travel. The same for the HOT, except that the vehicle may be located in the front of the vehicle group. As the vehicle group may switch directions, and the vehicles within the group may be changed out for other vehicles or just removed or reordered, the EOT and HOT are discussed in relative terms. The EOT may communicate the location of the vehicle, and thereby the vehicle group, and/or the occurrence of the hazard event to the controller, to a wayside device, and/or to a remote server. The location data may be sent to the controller, the wayside device, and/or the remote server with the notification of the hazard event. The location data may be sent to the controller, the wayside device, and/or the remote server(s) separate from the notification of the hazard event.

The EOT/HOT and sensor system may be one or more of crash-hardened, fire proof, water proof, electrical proofed, EMP resistant, impact resistant, corrosion resistant, and the like. With the selection of features based at least in part on the application specific parameters, the device may continue to function in case of a hazard event to provide redundancy in the ability to communicate a notification of a hazard event, such as in the event of loss of a controller in the vehicle.

The hazard event alert system may include a wayside device located alongside or associated with a portion of a route. The wayside device may form part of, may include, or may be connected to another device and/or system located in or associated with the portion of the route. The wayside device may form part of, may include, or may be connected to a wayside data communications device and/or system and/or an automatic vehicle operation device and/or system. The wayside device may communicate with one or more controllers, one or more EOT/HOT, one or more remote servers, one or more sensors, and/or one or more positioning devices. The wayside device may communicate via one or more communication device.

The wayside device may receive a notification concerning the occurrence of a parameter or condition sensed or determined from a sensor. In case that a notification concerning the occurrence of a parameter or condition sensed or determined by the sensor is received by the wayside device, the wayside device may communicate a hazard event notification to a controller, to an EOT, and/or to a remote server associated with a specified entity.

In the case that the wayside device communicates the notification of the hazard event to the controller, the wayside device may receive confirmation of receipt of the notification communicated from the wayside device to the controller. The wayside device may receive the confirmation of receipt after communicating a request for a confirmation of receipt of the notification to the controller. The wayside device may receive the confirmation of receipt without or before communicating a request for a confirmation of receipt of the notification to the controller.

If the wayside device does not receive confirmation of receipt of the notification of the hazard event communicated from the wayside device to the controller, which may result due to the unavailability of the operator, the wayside device may communicate a hazard event notification to one or more remote servers.

A notification of a hazard event communicated by the wayside device may push an alert to users and first responders who have an alert application installed on their mobile device. The alert may contain a location of the event, a material transported, an amount of material, and/or recommended actions to take in response to the hazard event. A notification of a hazard event communicated by the wayside device may result in a track restriction so that other vehicle groups would be aware of the incident and take appropriate actions.

The wayside device may communicate a hazard event notification to one or more remote servers before or without waiting to receive confirmation of receipt of the notification of the hazard event communicated from the wayside device to the controller. In this circumstance, the controller may validate or invalidate the notification of occurrence of the hazard event. The controller may further communicate the validation or invalidation of the notification of occurrence of the hazard event to a remote server.

The wayside device may receive location data from a positioning device, which may or may not be located in or associated with the portion of the track of the wayside device. The wayside device may communicate the location of the vehicle group and/or the occurrence of the hazard event to the controller or to a remote server associated with a specified entity or a remote server of a central office associated with the vehicle group. The location data may be sent to the controller or the remote server with the notification of the hazard event. The location data may be sent to the controller or the remote server separate from the notification of the hazard event. The wayside device may facilitate the indirect communication from the controller to the remote server or from the EOT to the controller and/or the remote server by receiving and transmitting communications.

In one embodiment, a cloud-based remote server may connect to another device and/or system with a separate function at the specified entity. The remote server may form part of, may include, or may be connected to a back-office system (BOS). The BOS may form associations with one or more of the vehicle group, a computer aided dispatch system, and an electronic vehicle group management system, and/or a vehicle network management system. A communication device may be coupled to the remote server.

The remote servers may directly and/or indirectly receive a notification concerning the occurrence of a parameter or condition sensed or determined from the one or more sensors. The remote servers may directly and/or indirectly receive a notification concerning the occurrence of a parameter or condition sensed or determined by the sensor from a controller, an EOT, and/or a wayside device. The remote servers may confirm receipt of a notification received by direct or indirect communication to the remote servers.

When a notification concerning the occurrence of a parameter or condition sensed or determined by the sensor is received by the remote server of the back-office system, the remote server may communicate a hazard event notification to another remote server associated with a specified entity other than the central office associated with the vehicle group. This notification may push an alert to users and first responders who have an alert application installed on their mobile device. The alert may contain a location of the event, a time of event initiation, a type of material transported by the vehicle or vehicle group, an amount of material, and/or recommended actions to take in response to the hazard event. The alert may include information regarding other first responders either at the location of the hazard event or en route. For example, the mobile devices carried by first responders may report locations of the mobile devices to the remote server(s). These locations can be used (e.g., by the remote server) to determine which first responders are located at the event and/or which first responders have headings directed toward the event. A notification of a hazard event communicated by the remote servers may result in a speed restriction so that other operators of vehicles and vehicle groups would be aware of the incident and take appropriately responsive actions. For example, responsive to receiving the notification, a remote server can send a warning signal to the vehicles and vehicle groups headed toward or within a designated distance (e.g., a stopping distance) of the event. This warning signal can instruct the vehicles to manually or automatically reduce speed to no more than an upper speed limit. Optionally, a dispatcher may receive the notification of the hazard event and communicate the speed restriction.

The specified entity other than the central office associated with the vehicle group may be determined based on the circumstances of the hazard event. By way of a non-limiting example, a notification of the hazard event may be communicated to the remote server, and the remote server of the back-office system may be configured to determine one or more specified entities to contact, and communicate a notification of the hazard event to one or more other remote servers associated with the one or more other specified entities. When the remote server communicates a hazard event notification to one or more other remote servers associated with a specified entity other than the central office associated with the vehicle group, the remote server may communicate to the specified entity by other methods, such as phone calls, text messages, simple network management protocol (SNMP) messages, or the like.

The remote server may communicate the notification of the hazard event to a remote server of another specified entity before or after validation or invalidation or without validation or invalidation. The occurrence of the hazard event may be validated before communicating the notification of the hazard event to a remote server associated with a specified entity. In the case that the occurrence of a hazard event is neither validated nor invalidated, the remote server may communicate the notification of the hazard event to another remote server associated with a specified entity.

One or more of the remote servers may validate or invalidate the occurrence of a hazard event based at least in part on communicating with an operator of a vehicle in the vehicle group and/or by comparing and contrasting other information. Other suitable validation information may include the receipt of a notification of the vehicle parameter or condition or the route parameter or condition.

In one embodiment, the remote server may validate or invalidate the occurrence of the hazard event. That is, the sensor might detect a possibly hazard event, and the next step is to confirm the occurrence before further response is taken. The validation, or invalidation, may be based at least in part on communications with an operator of a vehicle involved in the hazard event. The remote server may request validation or invalidation from the operator via an input device. If validation of the occurrence of the hazard event is received via the input device, then the remote server may communicate a notification of the hazard event to a remote server associated with a specified entity. If no validation or invalidation of the occurrence of the hazard event is received via the input device, which may result due to the unavailability of the operator, then the remote server may communicate a notification of a hazard event to another different remote server associated with a specified entity.

The remote server may receive a notification of an occurrence of a hazard event from an operator of the vehicle group via an input device associated with the locomotive or the operator without receiving a notification concerning the occurrence of a parameter or condition sensed or determined by the sensor. The remote server may further communicate the notification of the hazard event to another remote server of another specified entity. By way of example, if a vehicle sensor senses a sudden stop indicative of an impact the system may attempt to communicate with the operator. If the operator responds there was no crash, the system does nothing. Otherwise, the system dispatches a repair and rescue and routes other vehicles around the location. If there is no response from the operator, the system dispatches emergency medical support.

One or more of the remote servers may receive a notification of a hazard event from an EOT or a wayside device. The notification may be received before or after validation of the occurrence of the hazard event.

One or more of the remote servers may compile and/or store a database of hazard event categories. The hazard event categories may include but are not limited to any hazard event category that is required, encouraged, and/or accepted by a specified entity. Specified entities may include a federal government authority, a state government authority, a local government authority, a central office associated with the vehicle group, a central office associated with another vehicle group, a central office associated with a vehicle that is in a mixed group, a maintenance entity, a medical entity, a search and rescue entity, a state police, a local police, an agency related to homeland security, or a combination of two or more thereof. Hazard event categories may include one or more of a vehicle collision event, a vehicle derailment event, a vehicle component failure, damage to a route, blockage of a route (by the vehicle or by another obstacle), or one of the foregoing that has occurred to another vehicle in the vehicle group or another route that is proximate to the instant route. For example, a derailment may block not only the tracks that a train is on, but also a set of routes running alongside.

The controller may determine the specified entity to be contacted based at least in part on the category of the hazard event. The remote server associated with the back-office system of the vehicle group may communicate an identity of the hazard event with the notification of the hazard event, or the identity of the hazard event may be sent separately.

One or more of the remote servers may include a database of determined hazard event severity categories. The severity categories may include any severity category that is required, encouraged, and/or accepted by a specified entity, such as a federal government authority, a state government authority, a local government authority, a central office associated with the vehicle group, another vehicle group, a central office associated with another vehicle group, a maintenance entity, a medical entity, a search and rescue entity, a state police, a local police, an agency related to homeland security, or a combination of two or more thereof. For example, a severity may be based on a number of vehicles involved and affected by the hazard event, a location of the hazard event, a type of route at the location of the hazard event, a grade of the land at the location of the hazard event, and/or a proximity to persons and/or structures potentially affected at the location of the hazard event. The severity may be based on a number of vehicles affected by the hazard event, which may be determined by a number of sensors sensing or determining the at least one parameter or condition. The severity may be based on whether a vehicle remains upright, such as after a collision, which may be determined by a sensed parameter or condition. The remote server may determine the specified entity to be contacted based on an identified severity of the hazard event. The remote server associated with back-office system of the vehicle group may communicate the severity of the hazard event with the notification of the hazard event, or the severity of the hazard event may be sent separately.

One or more of the remote servers may receive location data from the positioning device, which may be located in or associated with the vehicle. The remote server may determine the specified entity to be contacted based on the location of the occurrence of the hazard event. The remote server may communicate the location of the vehicle, the vehicle group and/or the occurrence of the hazard event to another remote server associated with another specified entity. The location data may be sent to the other remote server with the notification of the hazard event or may be sent separately.

One or more of the remote servers may include a database of determined communications to be made in the event of a hazard event. The database of determined communications to be made may include any communication that is required, encouraged, and/or accepted by a specified entity, such as a federal government authority, a state government authority, a local government authority, a central office associated with the vehicle group, another vehicle group, a central office associated with another vehicle group, a maintenance entity, a medical entity, a search and rescue entity, a state police, a local police, an agency related to homeland security, or a combination of two or more thereof. The database of determined communications may include contact information for vehicle owners, insurers and first responders so that appropriate parties within the location of or for the category and/or severity of the hazard event are contacted in the event of a hazard event.

The database of determined communications may be used to determine the specific entities to be contacted based one or more parameters or conditions related to the hazard event. This may include the category of the hazard event, the severity of the hazard event, and/or the location of the hazard event. One or more of the remote servers may include an event log in the form of a data storage device and/or system. The event log may record the occurrence of a parameter or condition sensed or determined by a sensor, a notification based on a parameter or condition sensed or determined by a sensor, a validated hazard event, an invalidated hazard event, and/or a notification of a hazard event received from an operator of the vehicle group via an input device.

One or more of the remote servers may include a materials storage log or manifest in the form of a data storage device and/or system. The materials storage log may record the type of hazard materials being transported, how much of the materials is being transported, and/or how to properly respond to the hazard event for the given hazard material. The remote server associated with a central office that is controlling the vehicle group may communicate at least a portion of the materials storage data with the notification of the hazard event, or the portion of the materials storage data may be sent separately. Note that as used herein "sent" may include posting for retrieval. That is, information may be posted to an electronic site accessible by a user who retrieves it from that site.

The hazard alert system may include a web portal. The web portal may be an interface through which users may define actions and configure the interface and script the interaction. The web portal may display alerts and report events. The contents of the push notifications may depend at least in part on the role of the users, such as whether the users are associated with a vehicle group or with a first responder.

FIG. 2 illustrates a flowchart of a hazard event alert method. The flowchart can represent operations performed by the hazard event alert system, such as the actions performed by and/or under direction of the controller. At 202, at least one parameter or condition associated with a hazard event is monitored. At 204, the data representing the parameter or condition is processed to detect occurrence of the hazard event. If the hazard event is not detected, the method can return toward 202 so that the parameter or condition can continue to be monitored.

If the hazard event is detected, the method can proceed toward 206. At 206, the location or position of the vehicle is determined. Since a hazard event was previously detected, the location or position of the vehicle may be the location or position of the hazard event or may indicate the location or position of the hazard event. At 208, a notification is generated based on the parameter or condition and the location or position of the vehicle. At 210, the notification is communicated to a back-office server, a specified entity, or any other remote server and/or device.

FIG. 3 illustrates a flowchart of another hazard event alert method. The flowchart can represent operations performed by the hazard event alert system, such as the actions performed by and/or under direction of the controller. At 302, a brake pipe pressure is monitored at an EOT of a vehicle group. Other parameters or conditions may be monitored by other devices and systems. At 304, it is determined whether a hazard event (e.g., derailment) has been detected based on the monitored brake pipe pressure. An alert is communicated to the controller at 306. After the alert is communicated to the controller, a determination is made at 308 as to whether a confirmation was received from the controller in response to the alert. If a confirmation is not received, the end-of-vehicle group computer may assume that a communication error has occurred due to a derailment or other hazard event and the method may proceed toward 318. At 318, a notification is generated. At 320, the notification is communicated. The hazard event notification may include various types of information including, for example, the detected parameter or condition, the position or location of the vehicle group, the type of hazard material being transported, a date and/or time, an identification of the vehicle group and/or locomotive, and/or any other information available to the controller, end-of-vehicle group computer, or head-end-unit.

The method may compare other sources of information to collaborate the hazard event. If there are two sensors, for instance, and only one registers an impact the system may choose to heighten the evaluation of the validity of the hazard event. Similarly, if two vehicles are known to be in proximity, notices may check with the second vehicle to see if the second vehicle: collided with the first vehicle, noticed a hazard event, or was otherwise similarly involved in the hazard event as well.

If a confirmation is received from the controller at 308, the method can proceed toward 309 and an indication of an alert is presented (e.g., visually and/or audibly) to an operator of the vehicle group. The indication may present the operator with one or more options. The operator is provided with an option to confirm the hazard event or parameter or condition and an option to cancel the alert (e.g., invalidate the hazard event or parameter or condition). At 310, a determination is made as to whether the operator confirmed the occurrence of a derailment or other hazard event. If a confirmation is received from the operator, the method can proceed toward 318 and a hazard event notification is generated.

If a confirmation is not received at 310 and the alert is cancelled (e.g., at 312), the method may end or, in some non-limiting embodiments or aspects, may proceed to 318 to generate the notification. However, in such circumstances, the notification transmitted at 320 may be transmitted to only a back-office system and other transmissions may be limited or not occur at all.

For example, if a derailment is confirmed at 310, the notification generated at 318 may be communicated at 320 to a back-office server, to various mobile devices, and to a specified entity (e.g., a governmental or regulatory agency). However, if the derailment is not confirmed at 310 and the alert is cancelled at 312, the notification generated at 318 may be communicated to only the back-office system and one or more mobile devices for recordation or other purposes, but not to the specified entity. If the derailment is not confirmed at 310 and the alert is not cancelled at 312, then a determination is made at 314 as to whether a determined time period has lapsed. If the time period has elapsed without a response from the operator of the vehicle group, it may be assumed as a default that a hazard event has occurred and the method can proceed toward 318 and 320. In this circumstance, the notification generated at 318 may be communicated to the back-office system, various mobile devices, and/or a specified entity, as an example.

In one embodiment, a hazard event alert system is provided that includes at least one sensor positioned on or associated with the vehicle group and configured to sense or monitor at least one parameter or condition; at least one communication device positioned on or associated with the vehicle group and programmed or configured to receive, process, and/or transmit data; at least one positioning system programmed or configured to detect a location or position of at least a portion of the vehicle group; and at least one computer positioned on or associated with the vehicle group and in communication with the at least one sensor, the at least one communication device, and the at least one positioning system, wherein the at least computer is programmed or configured to: determine that a hazard event occurred based at least partially on data generated by the at least one sensor; determine or receive the location or position of the at least a portion of the vehicle group from the at least one positioning system; generate a hazard event notification based at least partially on the at least one condition and the location or position of the at least a portion of the vehicle group; and communicate the hazard event notification to at least one of a back-office system and at least one remote server associated with at least one specified entity.

A computer-implemented hazard event alerting method is provided. A parameter or condition associated with a hazard event is detected, as well as a position or location of the vehicle group with the at least one positioning system. The hazard event occurrence may be based at least partially on a determination that a manual confirmation input is received from the operator of the vehicle group, a manual confirmation input is not received from the operator of the vehicle group within a determined time period, or a communication error between a controller and at least one of an end-of-vehicle group computer and the at least one sensor, or a combination thereof. A hazard event notification may be generated based at least partially on the at least one condition and the position or location of the vehicle group; and transmitting the hazard event notification to at least one remote server.

A hazard event alert system includes at least one sensor positioned on or associated with the vehicle group and configured to sense or determine at least one condition associated with a hazard event; at least one communication device positioned on or associated with the vehicle group and programmed or configured to receive, process, and/or transmit data; at least one positioning system programmed or configured to sense or determine a location or position of at least a portion of the vehicle group; and at least one computer positioned on or associated with the vehicle group and in direct or indirect communication with the at least one sensor, the at least one communication device, and the at least one positioning system. The at least one computer may: generate or receive a notification based at least partially on the at least one condition sensed or determined by the at least one sensor; determine or receive a location or position of at least a portion of the vehicle group based at least partially on the location or position sensed or determined by the at least one positioning system; and communicate a notification of a hazard event to at least one of the following: a controller located in or associated with the at least one locomotive of the vehicle group; an end-of-vehicle group computer located in or associated with at least one railcar of the vehicle group; a remote server associated with a specified entity; or any combination thereof.

In one embodiment, a method includes identifying a blocked or damaged location and responding thereto. The blocked or damaged location may be an intersection, or a determined segment of a route, or segments adjacent thereto. Blocked may refer to an object that would interfere with travel through the location, and may include total blockage or partial blockage. An example of total blockage may be a rockslide that cover the route, or a stalled or incapacitated vehicle. Partial blockage may be snow, water, leaves or foliage. It may be possible to navigate a partially blocked location (or not) in a non-standard operating mode other than a normal operating mode. Suitable non-standard operating modes may include slower travel than a speed limit might permit, use of a lower speed higher torque gear set, driving onto a shoulder or through a detour, and the like.

The method may be implemented with a blocked crossing detection and notification system that includes a controller (which includes at least one processing device), a communications interface communicatively coupled to the controller and a detection system. The controller may facilitate communications between the controller and at least one external device. The detection mechanism may be placed proximate to a location, such as a rail grade crossing or an automobile intersection or a marine vessel crossing lane (e.g., the mouth of a harbor or river). The detection mechanism may communicate with the controller. The method includes periodically operating the detection mechanism. Assessing signals from the detection mechanism to determine the presence or absence of a blockage within a defined area surrounding an intersection of a roadway and a route. And periodically, but not continuously, delivering information regarding the assessed real time presence or absence of a blockage to the at least one external device at a location remote from the defined area. A monitoring organization may receive the assessed presence or absence of the potential blockage at the location remote from the defined area and may analyze an assessed blockage in real time and execute a commensurate response. The assessment may include a degree of blockage, a type of blockage, or simply the presence or absence of the blockage.

In one embodiment, a hazard event alert system includes at least one positioning system programmed or configured to detect a location or position of a vehicle or a portion of a vehicle group that includes the vehicle. The system also includes at least one sensor positioned on or associated with the vehicle and configured to generate sensor data of a determined parameter or condition. The system also includes a controller in communication with the sensor and the at least one positioning system. The controller is programmed or configured to determine that a hazard event has occurred or is predicted to occur based at least partially on the sensor data and to communicate a hazard event notification to a remote server based at least in part on the location or position that is detected and the sensor data.

The controller can be configured to communicate the hazard event notification to one or more of a federal government authority, a state government authority, a local government authority, a maintenance entity, a medical entity, a search and rescue entity, a state police, a local police, and/or an agency related to homeland security. The authority, police, or agency receiving the notification can then dispatch or otherwise appropriately respond to the hazard event being detected.

The at least one sensor can include one or more of a rotational sensor, a gyroscope, an accelerometer, a pressure sensor, a thermocouple, a smoke detector, or a combination of two or more thereof. Optionally, the at least one sensor can include a pressure sensor adapted to monitor brake pipe pressure, and the end-of-train device can be in communication with the pressure sensor and programmed or configured to determine that the hazard event has occurred based on a change in the brake pipe pressure.

The vehicle can be a locomotive, the vehicle group can be a train, and the controller can be an end-of-train device, head-end unit, or a head-of-train device.

The controller can be configured to respond to a determination that the hazard event has occurred or is predicted to occur by displaying an alert to an operator of the vehicle. The controller can be configured to receive an input from the operator confirming or invalidating occurrence or prediction of the hazard event. For example, the operator may have additional information or insight on whether the hazard event actually occurred and/or whether the conditions indicate that the hazard event actually occurred. The operator can refute or confirm the hazard event using this additional information or insight and respond accordingly to avoid or reduce false-positive detection events.

The controller can be configured to direct communication of the hazard event notification to the remote server in response to determining one or more of a requested input from an operator of the vehicle is not received by the controller within a determined time period, the requested input from the operator confirming occurrence of the hazard event, and/or a communication error occurred with the controller. For example, if the controller does not receive input from an operator that confirms or refutes that the hazard event occurred or is likely to occur (e.g., within a designated time period of receiving the sensor data), then the controller can communicate the notification as a safeguard or default action. This can prevent operator inattention or delay, operator mistake, or communication errors from stopping communication of the notification. As another example, the controller can be configured to selectively notify a specified entity with the hazard event notification based at least partially on the location or position of an occurrence of the hazard event, a category of the hazard event, a severity of the hazard event, and/or an identity of a material being transported by the vehicle or the vehicle group.

The controller can be configured to communicate with a vehicle location server and obtain one or more of a vehicle location and a time at which the vehicle location was reported. This server can be a BOS as described herein.

The sensor may be a tilt sensor and the controller can be configured to dispatch (or order dispatch of) a repair and maintenance crew to the location of the vehicle in response to the tilt sensor indicating that the vehicle is not upright. As another example, the sensor can be a smoke detector and/or a fire detector, and the controller can be configured to dispatch a fire fighting crew to the location of the vehicle in response to the fire detector detecting fire or the smoke detector detecting smoke.

Also provided herein are a system, method, and apparatus for determining a location of a vehicle system, such as the location of the end of the vehicle system. The vehicle system can be formed from one vehicle, or two or more vehicles that are mechanically or logically coupled. Logically coupled vehicles include vehicles that communicate with each other to coordinate movements of the vehicles with each other so that the vehicle travel together as a group, even though the vehicles may not be mechanically connected with each other. The vehicle system can be a train formed from rail vehicles, or may be formed from other types of vehicles, such as automobiles, trucks, marine vessels, aircraft (e.g., manned or unmanned, drones, etc.), agricultural vehicles, mining vehicles, or other off-highway vehicles.

The system can include a plurality of passive transponders located throughout a route network that each include transponder data uniquely identifying a route segment or location where the transponder is positioned, such as, but not limited to, a portion of a route, a switch, a region, coordinates, and/or the like. The transponder data may be any type of data that uniquely identifies a route segment or location and, in a preferred and non-limiting embodiment, includes a unique identifier that can be correlated with a route location from a route database. Moreover, the transponders may be located anywhere throughout a route network and may be located adjacent a clearance point of a switch or adjacent a route segment approaching a clearance point of a switch. However, it will be appreciated that transponders may be positioned at other locations throughout the route network to control movement of multiple vehicle systems by establishing boundaries that may be used to hold vehicle systems in a particular location for traffic control or the like.

A vehicle system can include an end-of-train (EOT) device arranged on an end of the vehicle system (e.g., on an end of a rear railcar) that includes a signal receiving device. The passive transponders and signal receiving device are configured such that when a train is traveling on a route, the signal receiving device activates and receives data from the stationary transponders. Thus, the transponders may be located on the route, adjacent the route, or in sufficient proximity to the route such that the signal receiving device is able to communicate with them. Using the transponder data stored on the transponders, an on-board computer on the vehicle system and/or the EOT device determines a location of the train and, particularly, a location of an end of the vehicle system relative to the route. By using passive transponders rather than active wayside equipment, less maintenance is required.

Also provided are a method and system for transmitting enforceable instructions in vehicle control systems such as PTC. The system and method verify geographic back office server (G BOS) normalization and vehicle system association of enforceable instruction data. The system and method generate data used by an on-board system to ensure that the G BOS delivers correct enforceable instruction data to the correct vehicle systems. The system and method can create multiple types of error-checking codes used to ensure each enforceable instruction is correct when received by a vehicle system and to ensure that the vehicle system has the correct set of enforceable instructions. The enforceable instructions include mandatory directives, permissive enforceable instructions, restrictive enforceable instructions, enforceable instructions to a vehicle system, or any combination thereof.

The method and system can communicate enforceable instructions that mitigate hazards that could occur in the transmission of the enforceable instructions from dispatch systems through a BOS to a vehicle system. Preferably, provided is a method and system for transmitting enforceable instructions in PTC systems that affect a PTC Office-Locomotive interface control document (ICD) and an on-board system and BOS segments of the PTC system, as well as introduces improved components to the BOS segment.

The method and system can ensure electronic delivery of an enforceable instruction (authority or bulletin) to the correct vehicle system and that the enforceable instruction is intact (e.g., not changed from when the enforceable instruction was generated by a dispatch system). This can obviate the need for redundant BOS segments to provide safety assurance and protection against hardware and software errors is obviated.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A system, comprising:

at least one positioning system programmed or configured to detect a location or position of a first vehicle or a portion of a first vehicle group that includes the first vehicle;

at least one sensor positioned on or associated with one or more of the first vehicle or a wayside device, the at least one sensor configured to generate sensor data of a determined parameter or condition;

a controller in communication with the at least one sensor and the at least one positioning system, and the controller being programmed or configured to:

determine that a hazard event has occurred or is predicted to occur based at least partially on the sensor data; and communicate a hazard event notification to one or more of a second vehicle, a second vehicle group, the wayside device, or a remote server based at least in part on the location or position that is detected and the sensor data.

2. The system of claim 1, wherein the controller is configured to communicate the hazard event notification to warn at least the second vehicle and prevent at least the second vehicle from a collision involving the hazard event.

3. The system of claim 1, wherein the controller is configured to identify a rockslide or a landslide as the hazard event based on the sensor data.

4. The system of claim 1, wherein the at least one sensor is positioned on or associated with the first vehicle.

5. The system of claim 1, wherein the at least one sensor is positioned on or associated with the wayside device.

6. The system according to claim 1, wherein the controller is configured to respond to a determination that the hazard event has occurred or is predicted to occur by displaying an alert to an operator of the first vehicle, the controller configured to receive an input from the operator confirming or invalidating occurrence or prediction of the hazard event.

7. The system according to claim 1, wherein the controller is configured to direct communication of the hazard event notification to the wayside device or the second vehicle in response to determining one or more of:

a requested input from an operator of the first vehicle is not received by the controller within a determined time period;

the requested input from the operator confirming occurrence of the hazard event; or a communication error occurred with the controller.

8. The system according to claim 1, wherein the controller is further configured to selectively notify a specified entity with the hazard event notification based at least partially on one or more of: the location or position of an occurrence of the hazard event, a category of the hazard event, a severity of the hazard event, or an identity of a material being transported by the first vehicle or the first vehicle group.

9. The system according to claim 1, wherein the controller is further configured to communicate with a vehicle location server and obtain one or more of a vehicle location and a time at which the vehicle location was reported.

10. The system according to claim 1, wherein the at least one sensor includes a tilt sensor and the controller is configured to dispatch a repair and maintenance crew to the location of the first vehicle in response to the tilt sensor indicating that the first vehicle is not upright.

11. A method, comprising:

detecting a location or position of a first vehicle or a portion of a first vehicle group that includes the first vehicle;

generating sensor data of a determined parameter or condition using at least one sensor positioned on or associated with one or more of the first vehicle or a wayside device, the at least one sensor configured to generate;

determining that a hazard event has occurred or is predicted to occur based at least partially on the sensor data; and communicating a hazard event notification to one or more of a second vehicle, a second vehicle group, the wayside device, or a remote server based at least in part on the location or position that is detected and the sensor data.

12. The method of claim 11, wherein the hazard event notification is communicated to warn at least the second vehicle and prevent at least the second vehicle from a collision involving the hazard event.

13. The method of claim 11, further comprising:

identifying a rockslide or a landslide as the hazard event based on the sensor data.

14. The method according to claim 11, further comprising:

displaying an alert to an operator of the first vehicle responsive to determining that the hazard event has occurred or is predicted to occur; and receiving an input from the operator confirming or invalidating occurrence or prediction of the hazard event.

15. A system, comprising:

a sensor configured to be positioned on or associated with a first vehicle and configured to generate sensor data indicative of a hazard condition; and a controller in communication with the sensor, the controller being programmed or configured to:

determine that a hazard event has occurred or is predicted to occur based at the sensor data; and communicate a hazard event notification to at least a second vehicle based at least in part on the sensor data.

16. The system of claim 15, wherein the controller is configured to communicate the hazard event notification to warn the second vehicle and prevent the second vehicle from a collision involving the hazard event.

17. The system of claim 15, wherein the controller is configured to identify a rockslide or a landslide as the hazard event based on the sensor data.

18. The system according to claim 15, wherein the controller is configured to respond to a determination that the hazard event has occurred or is predicted to occur by displaying an alert to an operator of the first vehicle, the controller configured to receive an input from the operator confirming or invalidating occurrence or prediction of the hazard event, the controller configured to communicate the hazard event notification responsive to receiving confirmation from the operator of occurrence or prediction of the hazard event.

19. The system according to claim 15, wherein the controller is further configured to communicate with a vehicle location server and obtain one or more of a vehicle location and a time at which the sensor data was reported.

* * * * *